US005762329A

United States Patent [19]

Nakazato et al.

[11] Patent Number: 5,762,329

[45] Date of Patent: Jun. 9, 1998

[54] SHEET POST PROCESSING APPARATUS

[75] Inventors: Takashi Nakazato; Masaki Ishida, both of Ebina, Japan

[73] Assignee: Fuji Xerox Co., Ltd., Tokyo, Japan

[21] Appl. No.: 760,960

[22] Filed: Dec. 5, 1996

[30] Foreign Application Priority Data

Dec. 6, 1995 [JP] Japan ..... 7-344370

[51] Int. Cl.[6] ..... B65H 39/02

[52] U.S. Cl. ..... 270/58.09; 270/58.12

[58] Field of Search ..... 270/58.08, 58.09, 270/58.11, 58.12

[56] References Cited

U.S. PATENT DOCUMENTS 5,508,799 4/1996 Irie ..... 270/58.07 X 5,599,008 2/1997 Yamashita et al. ..... 270/58.08 X

FOREIGN PATENT DOCUMENTS

A-5-162919 6/1973 Japan .

A-4-257496 9/1992 Japan .

*Primary Examiner*—Hoang Nguyen

*Attorney, Agent, or Firm*—Oliff & Berridge, PLC

[57] ABSTRACT

A sheet post processing apparatus includes the following elements: a tray; a stapling unit; a post processing setter; a stapling controller; a punching controller; and a post processing modification controller. The post processing setter sets details relating to the stapling and punching of the sheet on which an image is to be formed. The punching controller determines information on the sheets stored in the tray as a result of the preceding job. The post processing modification controller changes details on the post process of the next job, if necessary, so as to prohibit, at least, a stapling operation. The post processing modification controller can also include a display indicating the status of execution or errors and can be programmed to execute a single batch job.

20 Claims, 37 Drawing Sheets

BEFORE MOVEMENT OF A PUNCHER

AFTER MOVEMENT OF A PUNCHER

SHEET POST PROCESSING APPARATUS

BACKGROUND OF THE INVENTION

The present invention relates to a sheet postprocessing apparatus appended to an image forming main unit. More particularly, the present invention relates to an improved sheet postprocessing apparatus that distributes and holds the sheets output from the image forming main unit in a plurality of trays, and which also carries out predetermined punching and stapling operations with respect to each sheet.

A sorter that distributes and holds paper, which serves as a sheet, in a plurality of bin-trays can be mentioned as a sheet postprocessing apparatus appended to an image forming main unit such as a copier. It has become very common to attach a stapler to this type of sorter so that a batch of collated sheets can be automatically stapled (or bound).

Further, in recent years, a demand has arisen for a batch of sheets to be further subjected to a punching operation (i.e., holes should further be punched in the sheets). The invention disclosed in, for example, the Unexamined Japanese Patent Application Publication No. Hei. 5-162919, is known as responding to such a demand.

Punching of holes in each sheet during the course of its travel and output is a commonly used punching operation of this type. The sheet postprocessing apparatus is arranged so as to make it possible to arbitrarily set the punching operation or to cancel that setting on a job-by-job basis.

A stapler and a puncher are incorporated into a sorter which serves as a sheet postprocessing apparatus, and stapling and punching operations are carried out in combination with respect to the sheet output from an image forming main unit such as a copier. With such an arrangement, the workability/productivity of postprocessing of a sheet is improved to a much greater extent. In contrast, there is a fear of undesired postprocessing of a large number of sheets as a result of erroneous setting of the processing.

Specifically, if a mixture of punched sheets and non-punched sheets are stapled together, it will be necessary to punch holes in the thus-bound sheets again when arranging them in a file. As a result, there arises a problem of a mixture of sheets to be doubly punched or a problem of the need for laborious removal of the flattened staples.

If the image forming apparatus is provided with a punching apparatus capable of changing the number of holes, e.g., between two holes and three holes, or a punching apparatus capable of changing the position of the hole, there may be a case where differently-punched sheets (e.g., they are different from each other with regard to the number and position of holes) are mixed together. If these sheets are stapled together, the previously-described problems will arise.

SUMMARY OF THE INVENTION

The present invention has been conceived to solve the previously described technical problems. The object of the present invention is to provide a sheet postprocessing apparatus which minimizes errors in postprocessing sheets by preventing a stapling operation while differently-punched sheets of a plurality of jobs are mixed together.

As shown in FIG. 1, the present invention relates to a sheet postprocessing apparatus that continuously receives sheets 2 which relate to a plurality of jobs and have images formed thereon by an image forming main unit 1, the sheet postprocessing apparatus comprising:

sheet holding means 3 that stores the sheets 2 having images formed thereon by the image forming main unit 1, into trays 3*a;* a stapling unit 4 for stapling one side edge of a batch of sheets 2 stored in the tray 3*a* of the sheet holding means 3 in a predetermined manner;

a punching unit 5 which is disposed in the course of travel of the sheet 2 having an image formed thereon by the image forming main unit 1, before arrival at the sheet holding means 3, and which punches holes in one side edge of the sheet 2 in a predetermined manner while it is in the course of travel;

postprocessing setting means 6 that sets details on postprocessing related to the stapling and punching of the sheet 2 having an image formed thereon;

stapling control means 7 which staples the batch of sheets 2 stored in the tray 3*a* in a predetermined manner according to the details of the stapling operation set by the postprocessing setting means 6;

punching control means 8 that punches holes in the sheet 2 in a predetermined manner while it is in the course of travel, according to the details of the punching operation set by the postprocessing setting means 6;

punching information determination means 9 that determines punching information on the sheets 2 stored in the tray 3*a* as a result of the preceding job; and postprocessing modification means 10 that changes details on the postprocessing of the next job so as to prohibit, at least, a stapling operation while differently-punched sheets 2 are mixed together on condition that the punching information received from the punching information determination means 9 is different from the details of the postprocessing of the next job set by the postprocessing setting means 6.

In the above-described technical means, the sheet postprocessing apparatus of the present invention may be integrally appended to the image forming main unit 1 such as a copier or a printer or may be disposed so as to be separable from the image forming main unit 1.

The "sheet" used herein comprises special image forming mediums, such as sheets for use in an OHP (Over Head Projector), as well as paper commonly used as a copy sheet or a print sheet.

It is only necessary for the sheet holding means 3 to have the trays 3*a* into which the sheets 2 having images formed thereon by the image forming main unit 1 are stored. The "tray 3*a*" is not limited to a plurality of sort-bin trays which enables a sorting operation. One or a plurality of specific trays specially designed for postprocessing purposes may also be used as the tray 3*a*.

It is possible to select known settings, means, methods, and structures with respect to the number of trays 3*a* of the sheet holding means 3 that permits a sorting operation, the drive means of the trays 3*a*, driving methods (e.g., a method of raising and lowering the trays), and the structure of the tray 3*a*, as required. The sheets 2 that are stored in the tray 3*a* at the time of the sorting operation may be arranged such that a set of sheets 2 are collated and stored in orderly sequence on a job-by-job basis. Further, it is possible to stack and hold a plurality of sheets having the same image formed thereon. Further, from the point of view of preventing variations in the sheets 2 stored in the tray 3*a*, it is desirable to provide the sheet postprocessing apparatus with tamper means for aligning the sheets 2 stored in the tray 3*a* with each other. Further, the sheet postprocessing apparatus may be arranged so as to output for example, the sheets 2 which do not need to be sorted, to a specific tray of the sort-bin-trays, or to output a tray provided separately from the previously-described sort-bin-trays.

Any stapling device may be selected as the stapling unit 4, as required, so long as it is capable of stapling the sheets 2 stored in the tray 3*a*. There is a wide range of stapling methods, and also, the selection of the stapling method is likely to vary from user to user. Therefore, it is desirable to design the sheet postprocessing apparatus so as to be able to select a variety of stapling modes (a corner-stapling mode, a single-stapling mode, and a dual-stapling mode), as necessary.

Any punching device which carries out a punching operation in a predetermined punching mode (e.g., a two-hole punching mode) may be used as the punching unit 5 so long as it is capable of punching the sheet 2 during the course of travel to the sheet holding means 3. In terms of a user demand for selection of the method of punching (e.g., the number and position of holes), it is desirable to design the sheet postprocessing apparatus so as to be able to select the different number and position of holes, as required.

The punching unit 5 may be disposed either inside or outside of the image forming main unit 1 so long as it is disposed in the course of travel to the sheet holding means 3.

The postprocessing setting means 6 may be postprocessing preset means 6*a* that previously sets details on postprocessing related to the stapling and punching of the sheet 2, on which an image is to be formed, before commencement of an image forming operation, as shown in FIG. 2. Alternatively, the postprocessing setting means 6 may be comprised of punching preset means 6*b* that previously sets details on the punching of the sheet 2 on which an image is to be formed, before commencement of an image forming operation, and stapling post-setting means 6*c* that sets details on the stapling of the sheet 2 on which an image is to be formed, after completion of the image formation.

In the case where the postprocessing means 6 is the postprocessing preset means 6*a*, it is only necessary for the staple processing control means 7 and the punching control means 8 to control stapling and punching operations according to the settings made by the postprocessing preset means 6*a*. Further, in the case where the postprocessing means 6 is comprised of the punching preset means 6*b* and the stapling post-setting means 6*c*, it is only necessary for the punching control means 8 to operate according to the settings made by the punching preset means 6*b*, whereas it is only necessary for the stapling control means 7 to operate according to the settings made by the stapling post-setting means 6*c*.

Any punching information device may be selected, as required, so long as it is capable of determining information about the holes of the sheet 2 already stored in the tray 3*a* as a result of the preceding job, at the time when the next job is carried out.

Although the "punching information" used herein may differ according to the type of punching unit 5, it designates information about the presence or absence of a hole, and the number and position of holes.

The "preceding job" designates one or all of a plurality of jobs which have already been carried out or will be carried out prior to the next job.

If the sheets 2 are removed from the tray 3*a*, details on the job (i.e., the preceding job) previously carried out will not place any constraint on jobs which will be carried out later. The "preceding job" and the "next job" used herein are based on the assumption that the sheets 2 are not removed from the tray.

The punching information determination means 9 may be specifically implemented by a device that stores the punching information about the preceding job set by the postprocessing setting means 6 in memory means and determines the punching information when the next job is subjected to postprocessing by retrieving the memory means. Alternatively, the punching information determination means 9 may be implemented by a device provided with punching state detection means for detecting a punched state of the batch of sheets 2 which are stored in the tray 3*a* as a result of the preceding job. The device determines the punching information on the basis of a detection signal output from the punching state detection means.

The design of the postprocessing modification means 10 may be changed, as required, so long as it modifies details on the postprocessing of the next job so as to prohibit, at least, execution of a stapling operation while the differently-punched sheets 2 are mixed together on condition that the punching information received from the punching information determination means 9 is different from the details of the postprocessing of the next job set by the postprocessing setting means 6. For example, the following embodiments of the postprocessing modification means 10 are mentioned according to the type of postprocessing setting means 6.

Where the postprocessing setting means 6 is the postprocessing preset means 6*a*, the postprocessing modification means 10 (which carries out a priority processing operation) may be provided with priority processing determination means 14 for determining which of a stapling operation or a punching operation will be accepted first, and priority processing control means 15, as shown in FIG. 2. The priority processing control means 15 executes the processing determined by the priority processing determination means 14 in a prioritized manner so as to accord with the punching information on condition that the punching information received from the punching information determination means 9 is different from details on the postprocessing set by the postprocessing determination means 6.

There will be no problem so long as the priority processing determination means 14 is set so as to process either the stapling operation or the punching operation by default in a prioritized manner. However, in terms of a response to the user demand, the priority processing determination means 14 should preferably be arranged so as to arbitrarily set the object to be subjected to the priority processing.

A representative example of the priority processing will be described hereinbelow.

In a case where a stapling operation is prioritized, if the postprocessing setting means 6 sets only the stapling operation during the next job on condition that priority processing is set to the stapling operation, and that the sheets stored in the tray 3*a* are currently being subjected to a predetermined punching operation, it will only be necessary to arrange the priority processing control means 15 to automatically execute the same punching operation as it has already been carried out during the preceding job as well as the stapling operation.

The "same punching operation as it has already been carried out during the preceding job" herein designates a punching operation which is carried out under the condition that is identical with the punching information about the preceding job (e.g., the presence or absence of holes, the number of holes, and the position of the hole).

If the postprocessing setting means 6 sets the stapling and punching operations during the next job on condition that the priority processing is set to the stapling operation, and that the sheets 2*a* stored in the tray 3*a* have not been punched during the preceding job, it will only be necessary to arrange the priority processing control means 15 so as to carry out solely the stapling operation by automatically canceling the punching operation.

In a case where the punching operation is prioritized, if the postprocessing setting means 6 sets only the stapling operation during the next job on condition that priority processing is set to the punching operation, and that the sheets 2 stored in the tray 3*a* are currently being subjected to a predetermined punching operation, it will only be necessary to arrange the priority processing control means 15 to automatically cancel the stapling operation.

Further, if the postprocessing setting means 6 sets the stapling and punching operations during the next job on condition that the priority processing is set to the punching operation, and that the sheets 2 stored in the tray 3*a* have not been punched during the preceding job, it will only be necessary to arrange the priority processing control means 15 so as to carry out solely the punching operation by automatically canceling the stapling operation.

Where the postprocessing setting means 6 is the postprocessing preset means 6*a*, the postprocessing modification means 10 (which prohibits a postprocessing operation) may be comprised of postprocessing prohibition means 16, as shown in FIG. 2. This postprocessing prohibition means 16 prohibits postprocessing of the next job on condition that the punching information received from the punching information determination means 9 is different from details on the postprocessing of the next job set by the postprocessing setting means 6.

In contrast, where the postprocessing setting means 6 consists of the punching preset means 6*b* and the stapling post-setting means 6*c*, the postprocessing modification means 10 (which prohibits a postprocessing operation) can be provided with at least the postprocessing prohibition means 16, as shown in FIG. 2. This postprocessing prohibition means 16 prohibits the stapling operation on condition that the stapling post-setting means 6*c* sets the stapling operation, and that the punching information determination means 9 determines that a mixture of differently-punched sheets 2 are stored in the tray 3*a*.

In some cases, some user will not want to automatically change the postprocessing operation by the postprocessing modification means 10. In such a case, the postprocessing modification means 10 is additionally provided with an advance notification means 11 which issues advance notice of the difference between the punching information received from the punching information determination means 9 and details of the postprocessing of the next job set by the postprocessing setting means 6, as shown in FIG. 1. It is desirable for the postprocessing modification means 10 to execute processing in conjunction with an instruction following the notice issued by the advance notification means 11.

Arbitrary means such as warning means or display means may be used herein as the advance notification means 11.

It is not necessary to notify the user of modifications to the postprocessing operation made by the postprocessing modification means 10. However, if the user demands to know the modifications of the postprocessing, it will be desirable to append post-notification means 12 to the postprocessing modification means 10, as shown in FIG. 1. The post-notification means 12 issues notice of execution of processing differing from details on the postprocessing set by the postprocessing setting means 6, on condition that such processing has been carried out.

An arbitrary means such as warning means or display means may be used herein as the post-notification means 12.

In a case where the post-notification means 12 is employed, and where the postprocessing setting means 6 is the postprocessing preset means 6*a*, there may be mentioned the postprocessing modification means 10 (which prohibits postprocessing and, then, carries out the postprocessing again) provided with the postprocessing prohibition means 16 which prohibits the postprocessing of the next job on condition that the punching information received from the punching information determination means 9 is different from details on the postprocessing of the next job set by the postprocessing setting means 6, and postprocessing reexecution means 17, as shown in FIG. 2. The postprocessing reexecution means 17 reexecutes the postprocessing of the next job on condition that the punching information accords with the details of the postprocessing of the next job reset by the postprocessing setting means 6 after the post-notification means 12 has issued a notice.

Similarly, in a case where the post-notification means 12 is employed, and where the postprocessing setting means 6 consists of the postprocessing preset means 6*b* and the stapling post-setting means 6*c*, the postprocessing modification means 10 (which prohibits postprocessing and, then, carries out the postprocessing again) may be provided with the postprocessing prohibition means 16 which prohibits the stapling operation on condition that the stapling operation is set by the stapling post-setting means 6*c*, and that the punching information determination means 9 determines that a mixture of differently-punched sheets 2 are stored in the tray 3*a*, and the postprocessing reexecution means 17, as shown in FIG. 2. The postprocessing reexecution means 17 reexecutes the postprocessing of the next job that has already been set or reset by the stapling postprocessing means 6*c* in conjunction with an instruction for reexecution of the postprocessing after the post-notification means 12 has issued a notice.

If the number of sorted sheets (i.e., R/L: run length) differs depending on the jobs, some tray 3*a* will contain only the sheets 2 of a single job even if a plurality of jobs are continuously accepted.

In such a case, the tray 3*a* that contains the sheets 2 of the single job does not need to be processed in the same way that the tray 3*a* which stores a mixture of sheets 2 of a plurality of jobs is processed. Therefore, in view of improvements in processing efficiency, it is desirable for the postprocessing modification means 10 to be additionally provided with single-job sheet postprocessing execution means 13, as shown in FIG. 1. This single-job sheet postprocessing execution means 13 unconditionally executes a stapling operation with respect to the tray 3*a* that solely contains the sheets 2 of a single job, on condition that the postprocessing setting means 6 sets the stapling operation.

A device which is comprised of mixed sheet determination means 13*a* and forcible stapling means 13*b* is an example of this type of single-job sheet postprocessing means 13, as shown in FIG. 2. The mixed sheet determination means 13*a* determines whether or not a mixture of sheets 2 of a plurality of jobs are contained in the tray 3*a* to be processed. The forcible stapling means 13*b* unconditionally staples the sheets 2 stored in the tray 3*a*, at least on condition that the postprocessing setting means 6 sets the stapling operation, and that the sheets 2 loaded in the tray 3*a* which is to be determined by the mixed sheet determination means 13*a* are determined as belonging to a single job.

Next, the operation of the sheet postprocessing apparatus of the present invention will be described.

Assume that the postprocessing setting means 6 sets details on the postprocessing relevant to the stapling and punching of the sheet 2 on which an image is to be formed.

Further, assume that the stapling control means 7 and the punching control means 8 execute stapling and punching operations of the next job in accordance with details on the settings of the stapling control means 7 and the punching control means 8 made by the postprocessing setting means 6.

Under these circumstances, the postprocessing modification means 10 modifies details on the postprocessing of the next job so as to prohibit, at least, execution of the stapling operation while the differently-punched sheets 2 are mixed together, on condition that the punching information received from the punching information determination means 9 is different from the details of the postprocessing of the next job set by the postprocessing setting means 6.

Consequently, the stapling operation is prevented from being executed while a mixture of differently-punched sheets 2 of a plurality of jobs are contained in the tray 3*a* to be processed.

For example, assume that sheet (1) of the preceding job is merely punched, and that the sheet 2(2) of the next job is merely stapled, as shown in FIG. 3. In such a case, if the stapling operation is prioritized, the sheets of the next job will be punched as well as stapled. Therefore, the sheets 2(1) and 2(2) are punched in the same manner, and then they are stapled.

In a case where the punching operation is prioritized, the stapling operation of the next job will be canceled. Therefore, the sheet 2(1) is punched, whereas the sheet 2(2) is not punched. Further, neither the sheet 2(1) nor the sheet 2(2) is stapled.

Further, in a case where a postprocessing operation is prohibited, the stapling job of the next job will be canceled. The sheet 2(2) is directly output without being punched and stapled. In the end, neither the sheet 2(1) nor the sheet 2(2) is stapled.

In the present invention, the advance notification means 11 issues advance notice of the difference between the punching information received from the punching information determination means 9 and details on the postprocessing of the next job set by the postprocessing setting means 6. For instance, the present invention adopts the method by which the postprocessing modification means 10 executes processing in accordance with a user's instruction following the notice issued by the advance notification means 11.

The post-notification means 12 issues notice of execution of processing which differs from details on the postprocessing operation set by the postprocessing setting means 6, on condition that such processing has been executed. For instance, the present invention adopts the method by which the user can ascertain how the postprocessing has been carried out upon glancing at the post-notification means 12, and the postprocessing of the next job is reexecuted under predetermined conditions.

The single-job sheet postprocessing execution means 13 unconditionally executes a stapling operation with respect to the tray 3*a* that includes only the sheets 2 of a single job, on condition that at least the stapling operation is set. As a result, the tray that includes the sheets 2 of a single job can be processed while being separated from a tray which holds a mixture of sheets 2 of a plurality of jobs.

DETAILED DESCRIPTION OF THE PREFERRED EMBODIMENTS

With reference to the embodiments shown in the accompanying drawings, the present invention will be described in detail hereinbelow.

(First Embodiment)

(1) Outline of a Sheet Postprocessing Apparatus

Figure 1:
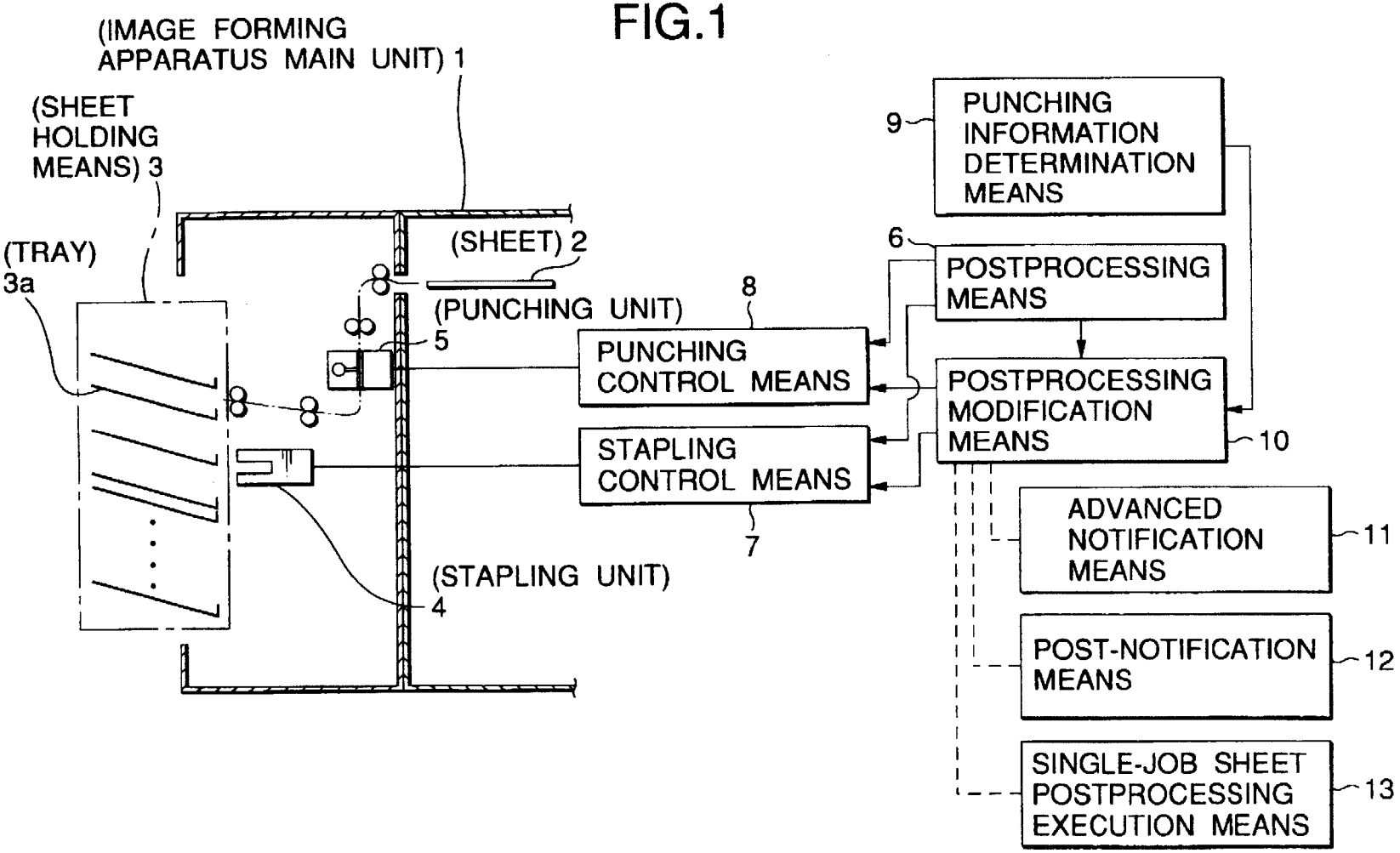
FIG. 1 is a schematic block diagram that shows the configuration of a sheet postprocessing apparatus according to the present invention.
Figure 2:
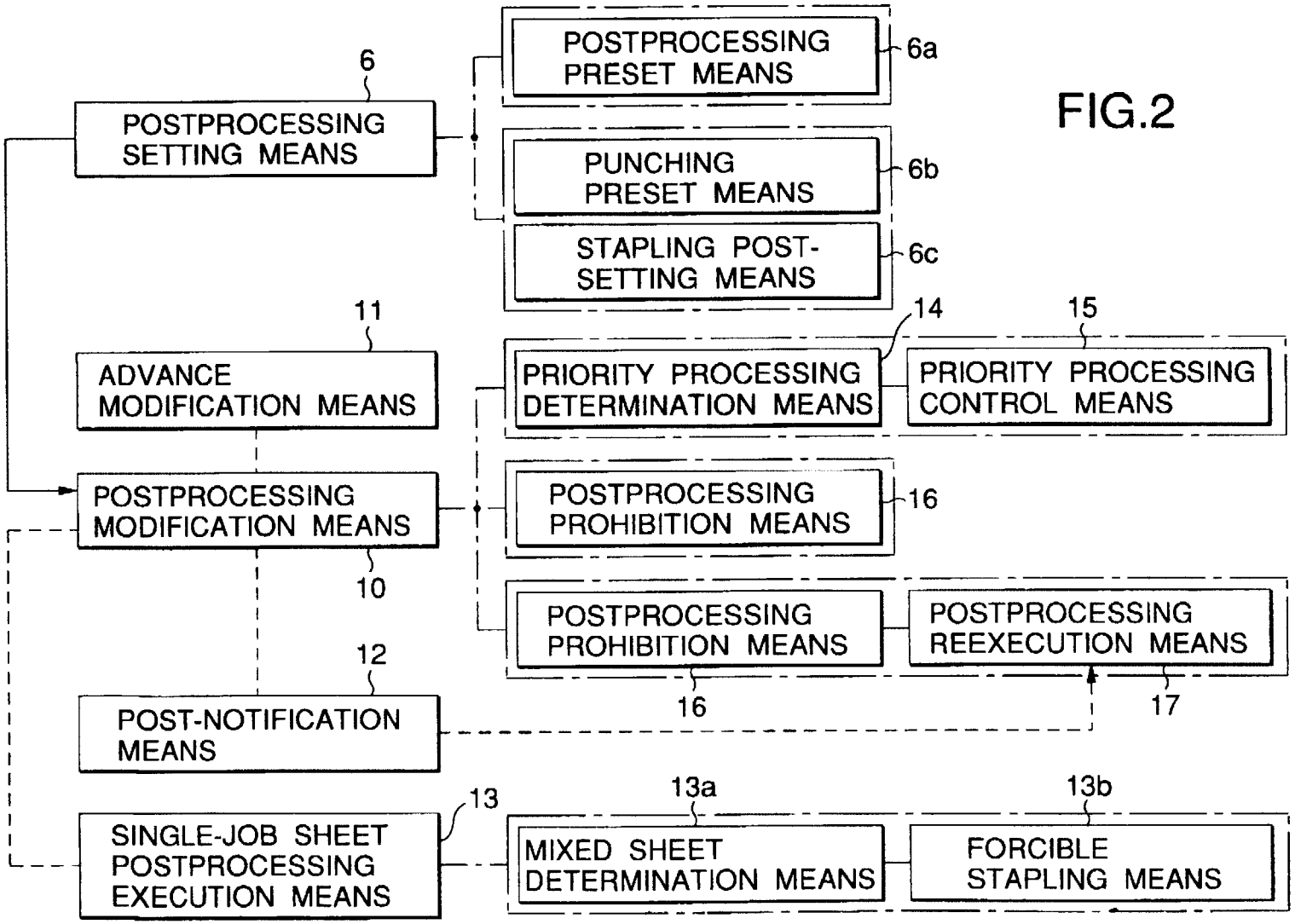
FIG. 2 is a block diagram showing a representative embodiment of the constituent elements shown in FIG. 1.
Figure 3:
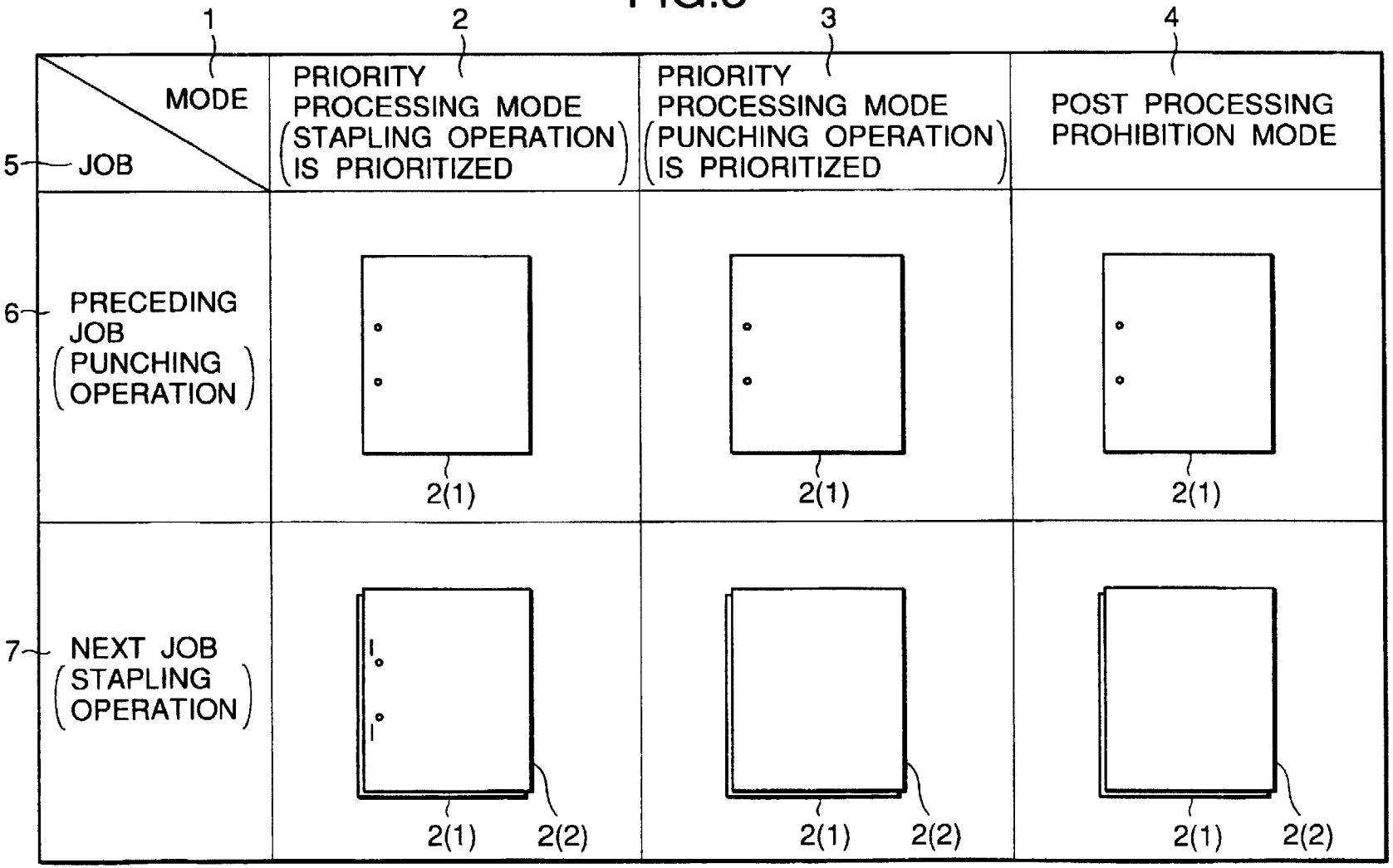
FIG. 3 is a schematic representation showing the operation of the sheet postprocessing apparatus according to the present invention.
Figure 4:
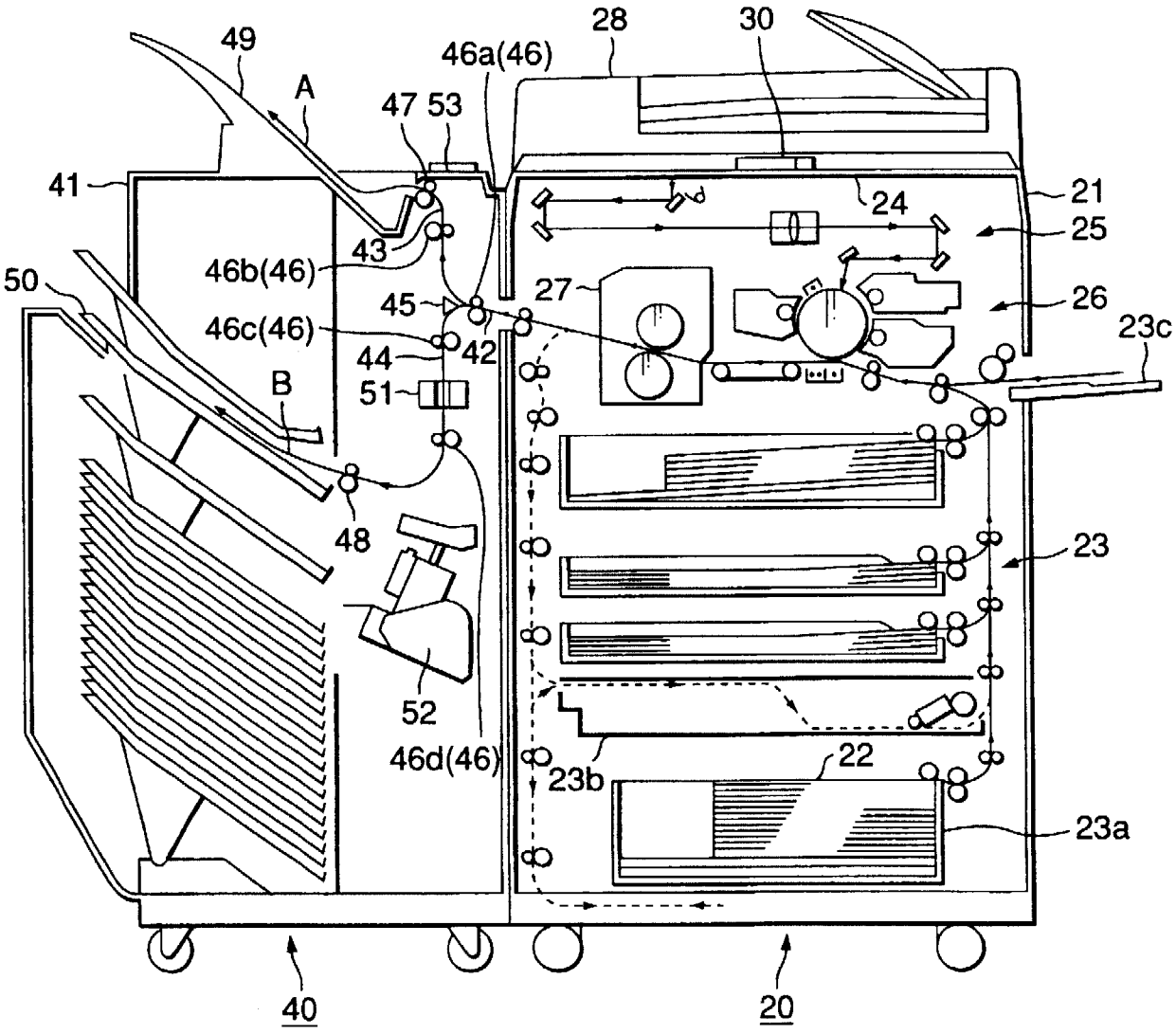
FIG. 4 is an illustrative cross-sectional view of an image forming apparatus and a sheet postprocessing apparatus according to a first embodiment of the present invention.

FIG. 4 is an illustrative representation of a copier made up of a copier main unit complete with a sheet postprocessing apparatus to which the present invention is applied.

In this drawing, a copier main unit 20 is comprised of a main unit housing 21, a plurality of cassette trays 23*a* for storing paper 22 which are used as sheets, a sheet storage section 23 provided with an intermediate tray 23*b* for double-sided copying/superimposing purposes and a tray 23*c* for use in manually inserting a sheet, an original scanning section 25 which is made up of a lamp, mirrors, and lenses and scans an original (not shown) placed on the top of a platen 24, and an image forming section 26 which forms a toner image on a photosensitive material using light reflected from the original and transfers the thus-formed toner image on the sheet 22 supplied from the sheet storage section 23, and a fixing unit 27 for fixing the toner image transferred on the sheet 22.

An automatic original feeder 28 for feeding originals one by one to a predetermined location on the platen 24 is disposed on the top of the main unit housing 21.

A control panel 30 is disposed on the top of the main unit housing 21. This control panel 30 is used in setting a variety of copy modes of the copier main unit 20 (e.g., a single-sided copying mode, a double-sided copying mode, the setting of a number of copies, an automatic magnifying mode, etc.). A control panel 30 is also provided on the top of the main unit housing 21 for setting a sheet postprocessing apparatus 40, which will be described later, to a predetermined postprocessing mode.

The sheet postprocessing apparatus 40 (which will be referred to as a "postprocessing apparatus" throughout embodiments of the present invention) is appended to the side of the copier main unit 20, in the present embodiment. The sheet postprocessing apparatus 40 carries out a postprocessing operation, such as a sorting operation, a stapling operation, and a punching operation, with respect to the sheet 22 output from the copier main unit 20.

The postprocessing apparatus 40 acts, in principle, as a sorter for sorting sheets. In the postprocessing housing 41, a transport path 42 for receiving the sheet 22 output from the copier main unit 20 branches into two paths; namely, a transport path 43 extended to a stacker and a transport path 44 extended to the sorter. A changeover gate 45 is disposed at this branch point, and a required number of transport rollers 46 (more specifically, rollers 46*a* to 46*d*) are disposed along the transport paths 42 to 44. Further, an output roller 47 is disposed at the exit of the transport path 43, and an output roller 48 is disposed at the exit of the transport path 44. A stack tray 49 for stacking the sheets 22 not to be sorted is disposed at the exit of the transport path 43, whereas a plurality of sort-bin trays 50 for distributing and storing the sheets 22 are disposed at the exit of the transport path 44.

A puncher (i.e., a punching unit) 51 for punching the sheet 22 during the course of its travel to the sorter is disposed in the transport path 44. A stapler (i.e., a stapling unit) 52 is disposed so as to be opposite to a bin tray of all the sort-bin trays 50 that is situated at a stapling stage. This stapling stage differs from a sheet distribution stage which faces the transport path 44 (i.e., the stapling stage is positioned below the sheet distribution stage in the present embodiment).

A postprocessing control panel 53 specially designed for use with the postprocessing apparatus 40 is disposed on the top of the postprocessing housing 41 of the postprocessing apparatus 40.

Next, the outline of operation of the copier according to the first embodiment will be described.

When the commencement of a copying action is instructed by a start switch of the control panel 30 disposed on the copier main unit 20, the original loaded in the automatic original feeder 28 is fed to the platen 24. The original scanning section 25 scans the original placed on the platen 24. A toner image is formed on the photosensitive material through commonly-known electrostatically charging, exposure, and development processes in the image forming section 26. The thus-formed toner image is transferred onto the sheet 22 transported from the sheet holding section 23, whereby the toner image corresponding to an image of the original is formed on the sheet 22. This toner image is then fixed on the sheet 22 in the fixing unit 27. The sheet 22 having the toner image fixed thereon is supplied to the postprocessing apparatus 40.

The sheet 22 supplied to the postprocessing apparatus 40 is switched to either the stack tray 49 or the sort-bin trays 50 by means of the changeover gate 45.

Where the sheet is output to the stack tray 49, the sheet 22 is guided along the transport path 43 by means of the changeover gate 45, as designated by arrow A shown in FIG. 4. Then, the sheet is output to the stack tray 49 by means of the transport roller 46 (i.e., **46*b*) and the output roller 47**.

In contrast, where the sheet is output to the sort-bin trays 50, the sheet 22 is guided along the transport path 44 by means of the changeover gate 45, as designated by arrow B shown in FIG. 4. Then, the sheet is output to the sort-bin trays 50 by means of the transport rollers 46 (i.e., **46*c* and 46*d*) and the output roller 48**.

In a case where postprocessing operations, that is, the stapling and punching operations, as well as a sorting operation, are set by the control panel 30, the sheet 22 is guided to the transport path 44 by means of the changeover gate 45.

The sheet 22 is temporarily suspended at the puncher 51 disposed in the course of the transport path 44 by the transport roller 46 (more specifically **46*c* and 46*d***), so that it is punched.

After completion of the punching operation, the sheet 22 is transported again by the transport roller **46*d*. As a result, the sheets 22 are sequentially output to and stored in the sort-bin trays 50 by the output roller 48**.

After the storing operation has been completed, the stapler 52 disposed so as to be opposite to the stapling stage sequentially staples the sheets 22 stored in the sort-bin tray of all the sort-bin trays 50 which is situated at the stapling stage.

Even if the sheets 22 are already stored in the sort-bin trays 50 as a result of the preceding job, it is possible to continuously accept a copying operation of the next job in the present embodiment.

In a case where the sheets 22 stored in the sort-bin tray 50 have already been punched as a result of the preceding job, a postprocessing operation of the next job will be carried out if only the stapling operation is set as a postprocessing mode for the next job using the control panel 30 (i.e., the differently-punched sheets are stapled, exactly as they are). To prevent this problem, a priority processing mode which will be described later is adopted as a modification algorithm which will be described later in the present embodiment. For instance, sheets of the next job are automatically punched as well as stapled in the mode in which a stapling operation is prioritized. Further, an indication of execution of the punching operation appears on a display of the control panel 30.

(2) Construction of the Postprocessing Apparatus

The detailed construction of the postprocessing apparatus will now be described.

(2a) Sorter

To begin with, a paper transport drive system in the postprocessing apparatus 4 will be described.

Figure 5:
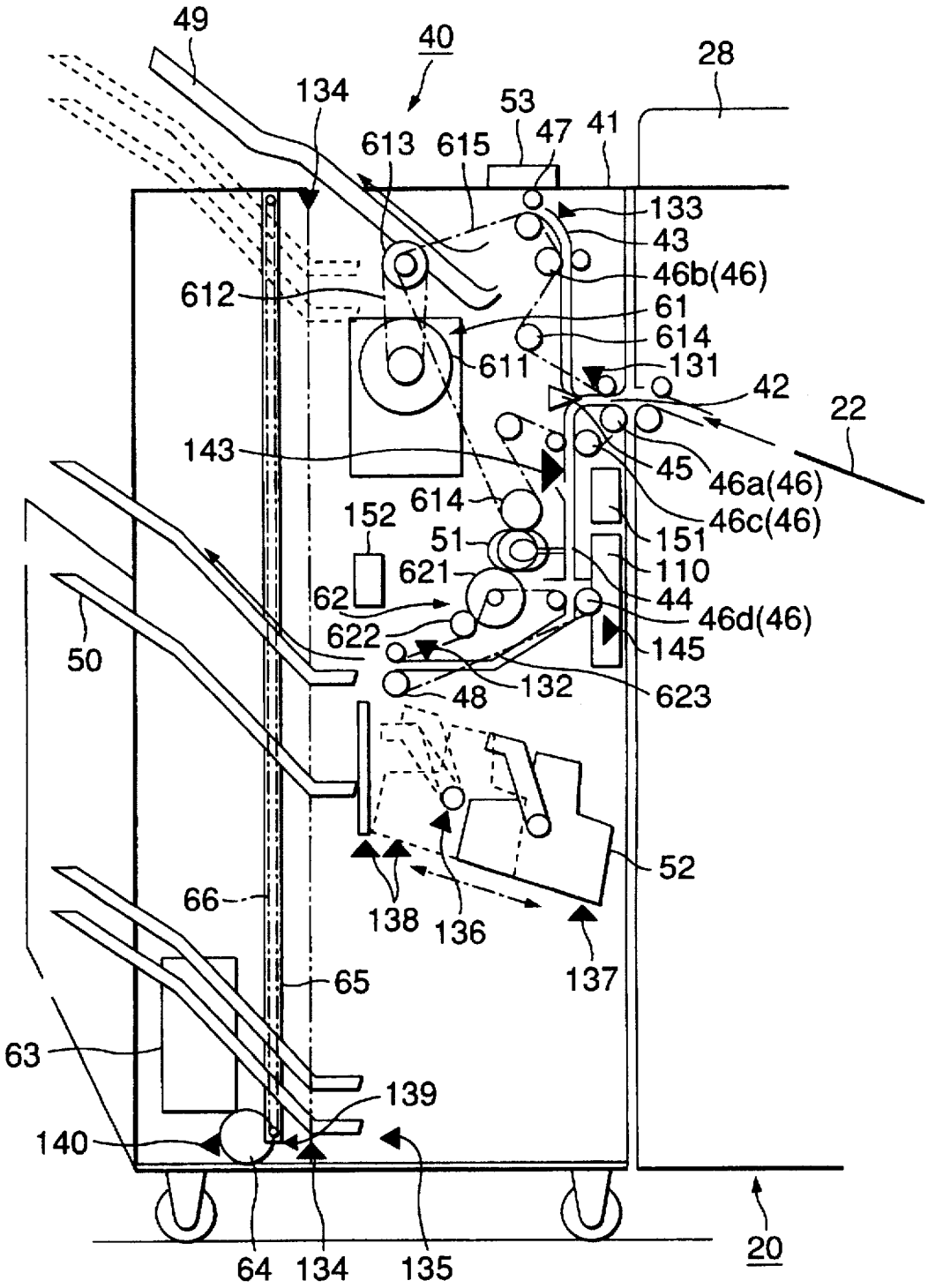
FIG. 5 is a cross-sectional view showing the details of the sheet postprocessing apparatus according to the first embodiment.

In FIG. 5, reference numeral 61 designates a first paper transport drive system which drives the transport rollers **46*a*–46*c* and the output roller 47, and reference numeral 62 designates a second paper transport drive system which drives the transport roller 46*d* and the output roller 48**.

In the drawing, the first paper drive transport drive system 61 is provided with a first paper transport motor 611 consisting of, e.g., a DC motor. A drive force of the first paper transport motor 611 is transmitted to a large diametrical portion of a coaxial two-stage pulley 613 via the transmission belt 612. Further, this drive force is transmitted to the transport rollers **46*a* to 46*c* and the output roller 47 by way of a transmission belt 615 wrapped around a smaller diametrical portion of the coaxial two-stage pulley 613, transmission pulleys (not shown) fitted around the drive shafts of the transport rollers 46*a* to 46*c* and the output roller 47, and a required number of intermediate pulleys 614**.

The second sheet transport drive system 62 is provided with a second sheet transport motor 621 comprised of, e.g., a pulse motor whose speed is easy to control. A drive force of this second sheet transport motor 621 is transmitted to the transport roller **46*d* and the output roller 48 by way of the transmission belt 623 wrapped around the transport roller 46*d*, a transmission pulley (not shown) fitted around the drive shaft of the output roller 48, and a required number of intermediate pulleys 622**.

In FIG. 5, reference numeral 63 designates a bin motor for raising or lowering the plurality of sort-bin trays 50 via a drive force transmission mechanism (not shown). Reference numeral 64 designates a tamper motor which aligns the sheets stored in the sort-bin tray 50 with each other by actuating a tamper 65 for tamping sheets, at predetermined timing by way of a drive force transmission mechanism 66 made up of a timing belt and ball screws.

Details on the drive force transmission mechanisms for use with the sort-bin trays 50 and the tamper 65 are disclosed in, e.g., the Unexamined Japanese Patent Application Publication No. Hei. 4-257496.

(2b) Stapler

The stapler 52 used in the present embodiment is positioned so as to be opposite to the sort-bin tray 50 situated at the stapling stage (i.e., the sort-bin tray 50 positioned below the sort-bin tray 50 situated at the sheet distribution stage in the present embodiment), as shown in FIG. 5.

Figure 6A:
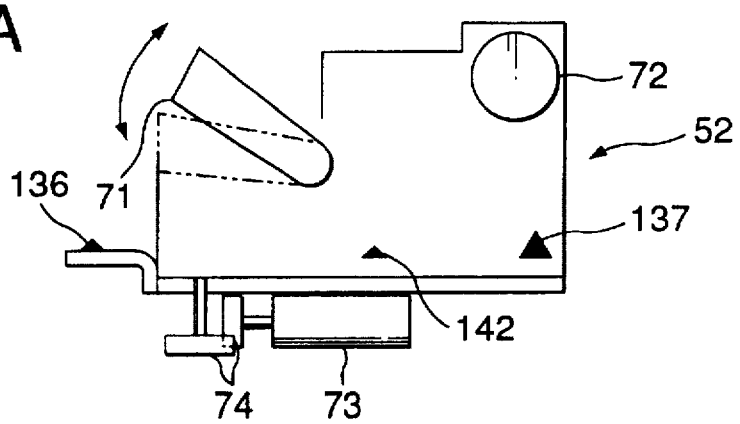
FIG. 6A is an illustrative front view showing the outline of a stapler (a stapling unit) used in the first embodiment.

In the present embodiment, the stapler 52 is provided with a stapler head 71, as shown in FIG. 6A. This stapler head 71 incorporates an unillustrated stapler. A drive force of a staple motor 72 is transmitted to the stapler head 71 by way of an unillustrated drive force transmission mechanism, so that the stapler head 71 opens and closes so as to carry out stapling operations.

Figure 6B:
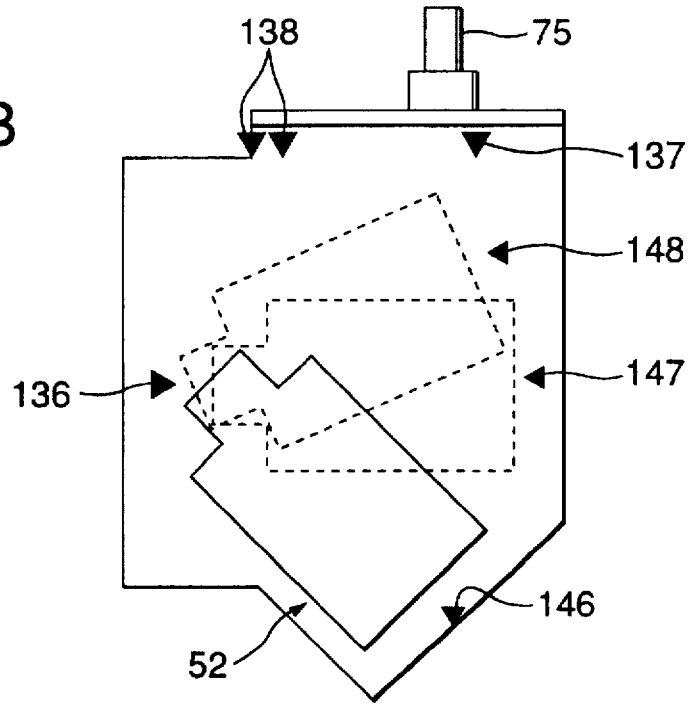
FIG. 6B is a plan view of the stapler shown in FIG. 6A.

The stapler 52 rotates around a stapling position of the stapler head 71 by transmission of a drive force from a head rotation motor 73 to a gear mechanism 74, as shown in FIGS. 6A and 6B. As a result, the stapler 52 can be set so as to staple the sheet in parallel with or at an angle with respect to the edge of the sheet.

Further, the stapler 52 travels forwards and backwards between the stapling position (designated by a dotted line shown in FIG. 5) and a standby position (designated by a solid line shown in FIG. 5) by way of a first stapler drive motor 75 and the drive force transmission mechanism in the present embodiment, as shown in FIG. 5.

Figure 6C:
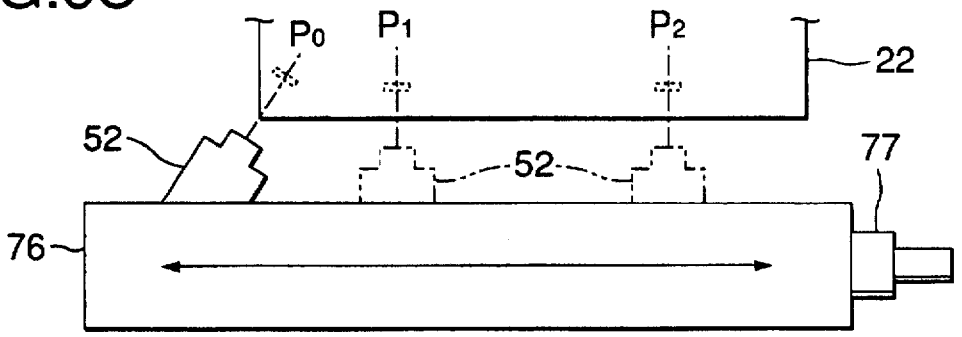
FIG. 6C is a diagrammatic representation showing several stapling modes of the stapler.

The stapler 52 is movably supported by a guide rail 76 that extends along the edge of the sheet 22 stored in an unillustrated sort-bin tray, as shown in FIG. 6C. The stapler 52 travels along the guide rail 76 by way of a second stapler drive motor 77 and an unillustrated drive force transmission mechanism, as required. This stapler 52 is set so as to stop at a predetermined position (e.g., a corner-stapling position P0, a single-stapling position P1, and dual stapling positions P1 and P2) according to a stapling mode.

The drive force transmission mechanisms for use with the stapler 52 are disclosed in, e.g., the Unexamined Japanese Patent Application Publication No. Hei. 4-257496.

(2c) Puncher

Next, details on the puncher of the present embodiment will be described.

Figure 7A:
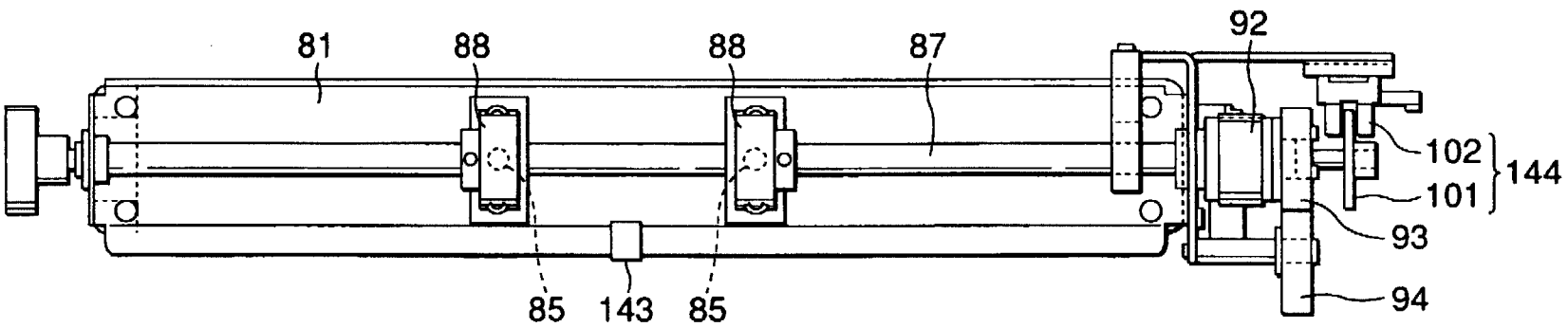
FIG. 7A is an illustrative plan view of a puncher of the first embodiment.
Figure 7B:
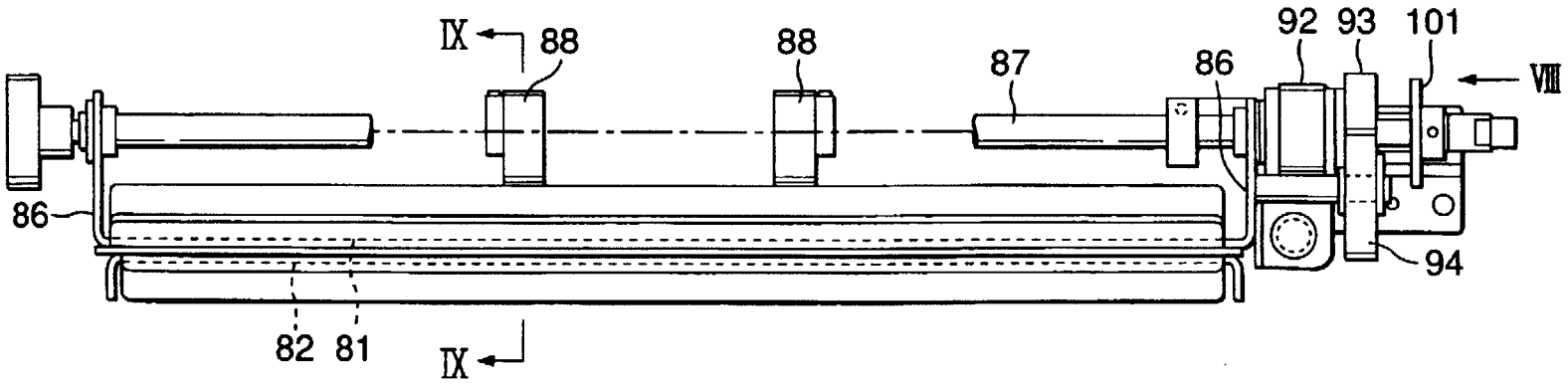
FIG. 7B is an illustrative front view of the puncher.
Figure 8:
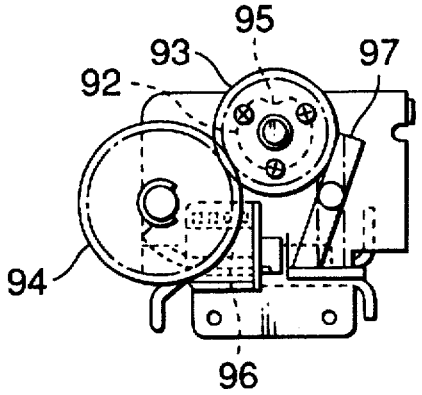
FIG. 8 is a side view of the puncher when viewed in the direction designated by VIII shown in FIG. 7B.
Figure 9:
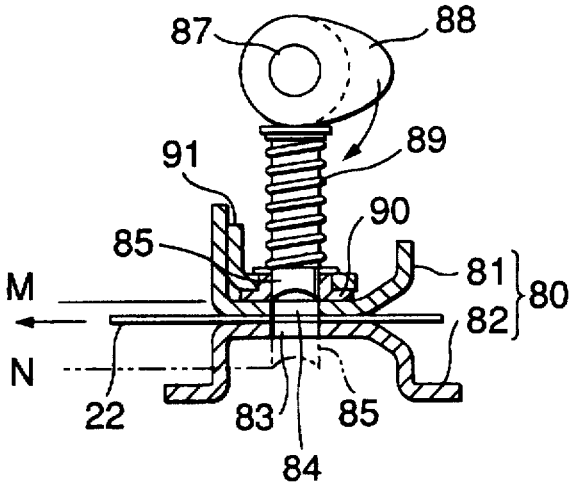
FIG. 9 is a cross-sectional view of the puncher taken across line IX—IX shown in FIG. 7B.

FIG. 7A is an illustrative plan view of a puncher of the first embodiment, and FIG. 7B is an illustrative front view of the puncher. FIG. 8 is a side view of the puncher when viewed in the direction designated by VIII shown in FIG. 7B. FIG. 9 is a cross-sectional view of the puncher taken across line IX—IX shown in FIG. 7B.

In these drawings, the puncher 51 has a pair of chute frames 80 (more specifically, chute frames 81 and 82) which form a transport path for the sheet. Through holes 83 and 84 are opened in each of the chute frames 81 and 82 so as to correspond to predetermined punching positions (two holes in the present embodiment). A punch pin 85 that freely passes through the through holes 83 and 84 is positioned above the through hole 83 of the chute frame 81. This punch pin 85 travels back and forth between a withdrawal position (designated by M using a solid line) and a protruded position (designated by N using a two-dot chain line). More specifically, the punch pin 85 retracts to the withdrawal position which is spaced away from the transport path formed between the chute frames 81 and 82, as well as completely protruding through the through holes 83 and 84 to the protruded position.

A mechanism to protrude and retract the punch pin 85 has the following structure in the present embodiment. For example, support walls 86 are integrally provided so as to stand upright at both longitudinal ends of the chute frame 81 which are perpendicular to the direction of transport of the sheet. A shaft 87 is rotatably provided between the support walls 86 via shaft bearing members. Substantially ellipsoidal eccentric cams 88, each of which has its portion bulged, are fixedly fitted around the shaft 87 so as to correspond to the punch pins 85. A resilient spring 89 consisting of a coil spring is coiled around the punch pin 85, whereby the punch pin 85 is constantly forced such that the head of the punch pin 85 maintains contact with the surface of the eccentric cam 88. The punch pin 85 travels back and forth as a result of movement of the head of the punch pin along the surface of the eccentric cam 88 by rotating the shaft 87 by a predetermined amount. In FIG. 9, reference numeral 90 designates a guide member attached to the chute frame 81 via a mount bracket 91. This guide member 90 guides the travel path of the punch pin 85 in a restrained manner.

A drive force transmission gear 93 is coupled to one end of the shaft 87 via a puncher clutch 92 in the present embodiment. A transmission gear (not shown) fixed to the shaft around which the intermediate pulleys 614 in the vicinity of the puncher 51 of the previously-described first sheet transport drive system 61 are fitted, meshes with the drive force transmission gear 93. A drive force of the first sheet transport drive system 61 is transmitted to the shaft 87.

The puncher clutch 92 is made up of, e.g., a spring clutch. A stop indentation 95 is formed in a part of the outer casing of the clutch, as shown in FIG. 8. Further, a stop link 97 is provided so as to pivot in conjunction with turning on/off actions of a solenoid 96. The stop link 97 meshes with the stop indentation 95 when the solenoid 96 is in an OFF state, whereby the shaft 87 is restrained by means of the spring force and the braking action of the stop link 97, and the drive force transmission gear 93 idles. When the solenoid 96 is in an ON state, the stop link 97 is disengaged from the stop indentation 95, whereby the braking action of the stop link 97 is canceled. As a result, the shaft 87 is coupled to the drive force transmission gear 93.

A punch home sensor 144 is disposed at one end of the shaft 87 in order to detect the reference position of the eccentric cam 88; i.e., the home position of the punch pin 85, in the present embodiment, as shown in FIG. 7A.

This punch home sensor 144 comprises a slit position detection plate 101 (the slit corresponds to the reference position) fixed to one end of the shaft 87. A photo-interrupter 102 is disposed such that the slit of the position detection plate 101 is placed in a detection space of the photo-interrupter. The reference position of the eccentric cam 88 is detected on the basis of an output from the photo-interrupter 102.

In FIG. 7A, reference numeral 143 designates a puncher entrance sensor which detects the rear end of the sheet as well as the entry of the sheet to the position of the puncher 51.

Figure 10:
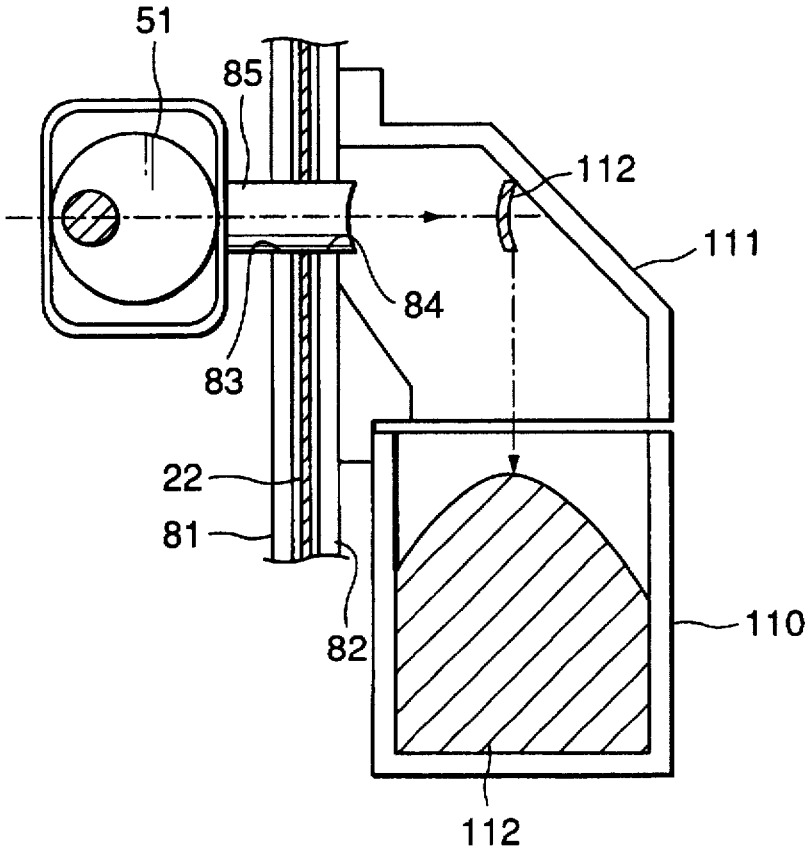
FIG. 10 is a diagrammatic representation showing the peripheral structure of the puncher used in the first embodiment.

A dust box 110 made of, e.g., synthetic resin, is disposed below the protruded position of the punch pin 85 in the vicinity of the puncher 51, as shown in FIG. 10. A dust container guide 111 made of, e.g., synthetic resin, is placed above the dust box 110. This dust container guide 111 has an inclined wall faced to the punch pin 85. After having come into collision with the inclined wall of the dust container guide 111, dust (i.e., wastes resulting from a punching operation) 112 drops into the dust box 110.

Figure 11:
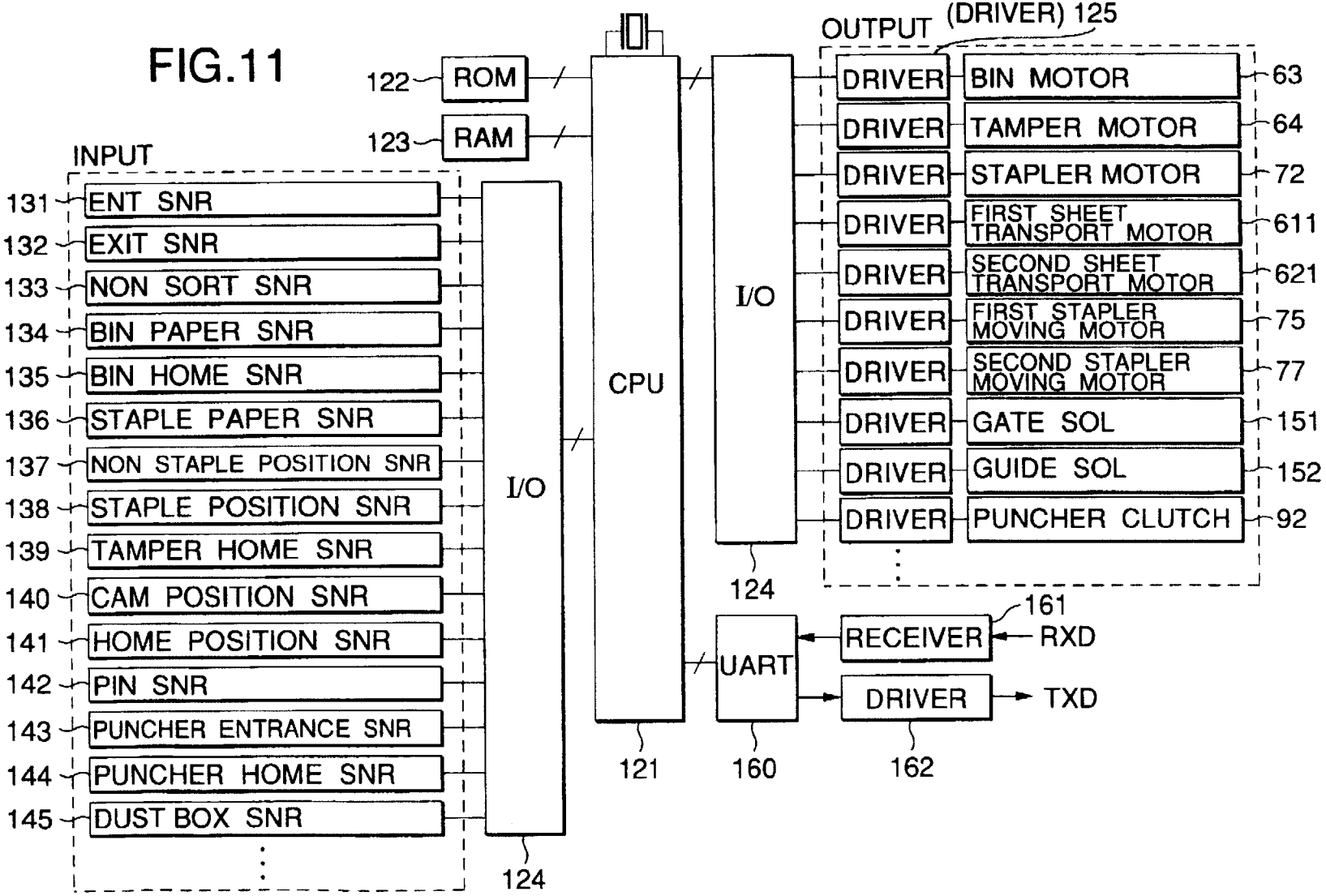
FIG. 11 is a block diagram showing a control system of the sheet postprocessing apparatus according to the first embodiment.

(3) Control System of the Sheet Postprocessing Apparatus (3a) Configuration of a Control System FIG. 11 is a block diagram showing a control system of the sheet postprocessing apparatus according to the first embodiment.

In the drawing, the control system is made up of a microcomputer system comprised of a CPU 121, ROM 122, and RAM 123. The CPU 121 receives various input signals via an I/O port 124 and executes postprocessing programs previously loaded into the ROM 122. After having generated a predetermined control signal, the CPU 121 sends the thus-generated control signal to a driver 125 of each output device via the I/O port 124.

With reference to the drawing, representative sensors for generating input signals (which are abbreviated as SNR in FIG. 11) will be described.

Postprocessing Entrance Sensor (ENT SNR in FIG. 5) 131

This sensor is disposed at the exit of the transport roller **46*a* along the transport path 42 so as to detect the entry of the sheet 22 output form the copier main unit 20 to the postprocessing apparatus 40**.

Exit Sensor (EXIT SNR in FIG. 5) 132

This sensor is disposed in front of the exit roller 48 along the transport path 44 so as to detect the output of the sheet to the sort-bin tray 50 after passage of the exit roller 48.

Unsorted State Sensor (UNSORT in FIG. 5) 133

This sensor is provided in front of the output roller 47 along the transport path 43 so as to detect the output of the sheet to the stack tray 49 after passage of the output roller 47.

Bin Paper Sensor (BIN PAPER SNR in FIG. 5) 134

They are disposed at both top and bottom ends of the postprocessing housing 41 so as to be opposite to each other so that light can pass through a part of each of the sort-bin trays 50. These sensors detect the presence of the sheet in any one of the sort-bin trays 50.

The sensors 134 produce a trigger signal as to whether or not a mixture of sheets of a plurality of jobs are stored in the sort-bin tray 50. Where the sensors 134 detect removal of the sheets from the sort-bin tray 50, information on the preceding job does not affect the next job. Therefore, that information is canceled.

Bin Home Sensor (BIN HOME SNR in FIG. 5) 135

This sensor is disposed so as to correspond to the initial position of the sort-bin tray 50 in the bottom layer so as to detect the home position of the sort-bin tray 50.

Staple Paper Sensor (STAPLE PAPER SNR in FIGS. 5, 6A, and 6B) 136

This sensor disposed in the vicinity of the front area of an open/close mouth of the staple head 71 of the stapler 52 so as to detect presence of the sheet on the sort-bin tray 50 at the time of the stapling operation.

Unstapling Position Sensor (UNSTAPLE SNR in FIGS. 5 and 6A) 137

This sensor is disposed in the vicinity of the stapler 52 so as to detect the presence of the staple head 71 in the withdrawal position (i.e., an unstapling position).

Stapling Position Sensor (STAPLING POSITION SNR in FIGS. 5 and 6B) 138

This sensor is disposed in the vicinity of the stapler 52 so as to detect the presence of the staple head 71 in a stapling position. However, the staple head 71 is located in different positions depending on the corner-stapling mode and the other stapling modes. Therefore, the two stapling position sensors 138 are disposed in the present embodiment.

Tamper Home Sensor (TAMPER HOME SNR in FIG. 5) 139

This sensor is disposed so as to be a tamper 65 and detects the reference position of the tamper 65.

Cam Position Sensor (CAM POSITION SNR in FIG. 5) 140

This sensor checks the position at which the sort-bin tray 50 stops.

The sort-bin trays 50 are raised and lowered by actuation of, e.g., unillustrated three cam shafts, in the present embodiment. The cam shafts are usually controlled so as to rotate one turn when one sort-bin tray is raised or lowered. At this time, the sensor 140 checks whether or not the cam shafts are stopped at their proper positions (i.e., whether or not the cam shafts have correctly rotated one turn).

Home Position Sensor (HOME POSITION SNR in FIG. 6A) 141

This sensor detects that the staple head 71 is open.

Pin Sensor (PIN SNR in FIG. 6A) 142

This sensor detects that the number of staples is reduced to become less than a predetermined number.

Puncher Entrance Sensor (PUNCHER ENTRANCE SNR in FIG. 5) 143

This sensor detects the rear end of the sheet as well as entry of the sheet to the position of the puncher 51.

Puncher Home Sensor (PUNCHER HOME SNR in FIG. 5) 144

This sensor detects that the punch pin 85 is situated in the home position.

Dust Box Sensor (DUST BOX SNR in FIG. 5) 145

This sensor detects a set condition of the dust box 110.

In addition, there are, for example, various sensors such as angle sensors 146 to 148 for detecting the angle of position of the stapler 52, as shown in FIG. 6B.

In FIG. 11, devices provided below can be mentioned as representative output devices;

Bin Motor 63 (FIG. 5)

Tamper Motor 64 (FIG. 5)

Stapler Motor 72 (FIG. 6A)

First Sheet Transport Motor (FIG. 5) 611

Second Sheet Transport Motor (FIG. 5) 621

First Stapler Drive Motor (FIG. 6B) 75

Second Stapler Drive Motor (FIG. 6C) 77

Gate Solenoid (GATE SOL in FIG. 5) 151

This solenoid actuates the changeover gate 45 so as to cause the switching between the transport path 43 and the transport path 44.

Guide Solenoid (GUIDE SOL in FIG. 5) 152

This solenoid guides the sheet when it is output to the sort-bin tray 50.

Puncher Clutch (PUNCHER CLUTCH in FIGS. 7A, 7B, and 8) 92

These clutches raise and lower the punch pins (i.e., the clutches performs a punching operation)

In FIG. 11, reference numeral 160 designates a communications control circuit (designated by UART in the drawing) for a serial signal. This communications control circuit 160 receives control data RXD from the copier main unit via a receiver 161 and sends control data TXD to the copier main unit via a driver 162.

(3b) Details on PostProcessing Operations

Figure 12:
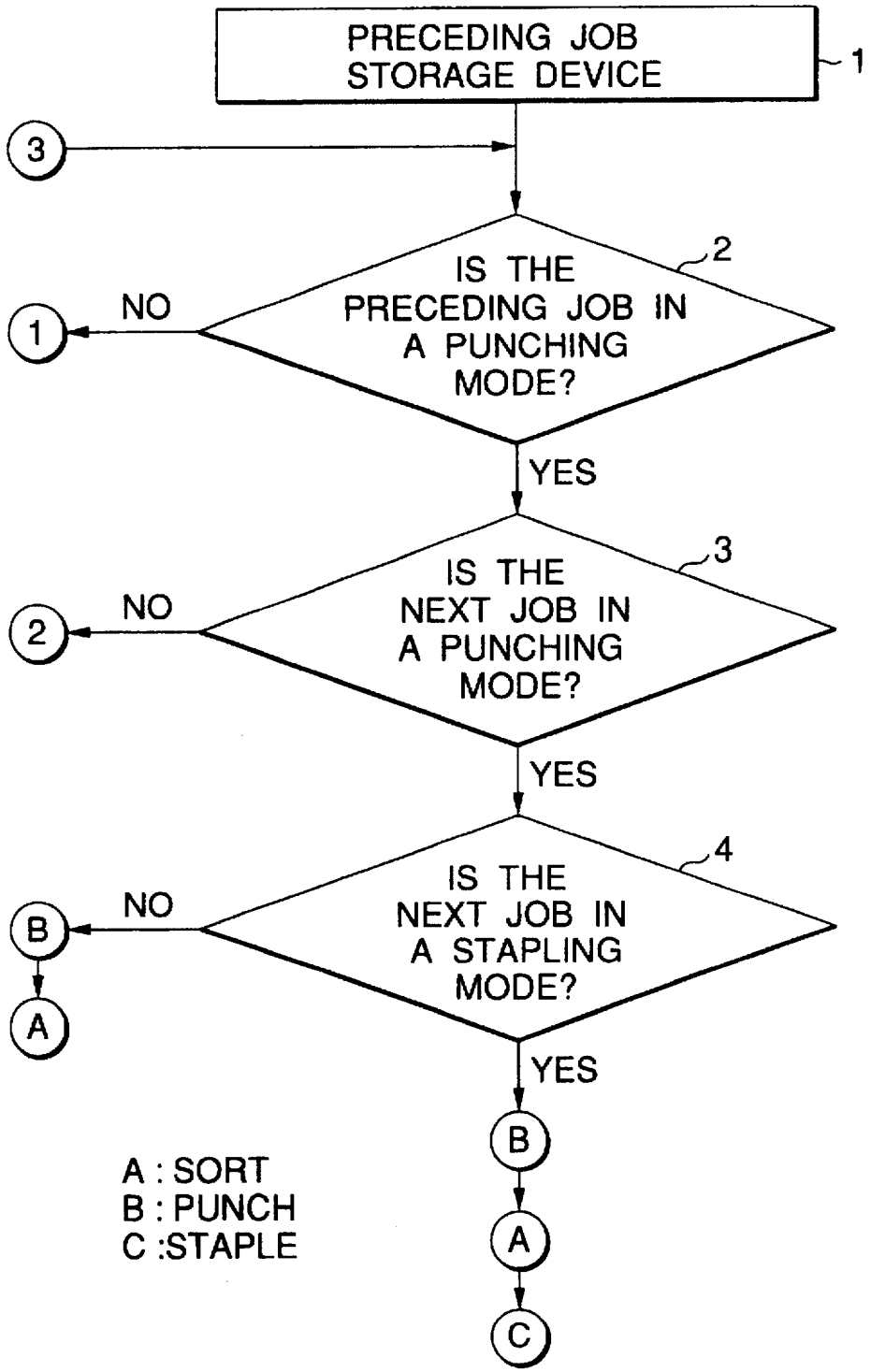
FIG. 12 is a flowchart showing processing processes of the sheet postprocessing apparatus according to the first embodiment.
Figure 13:
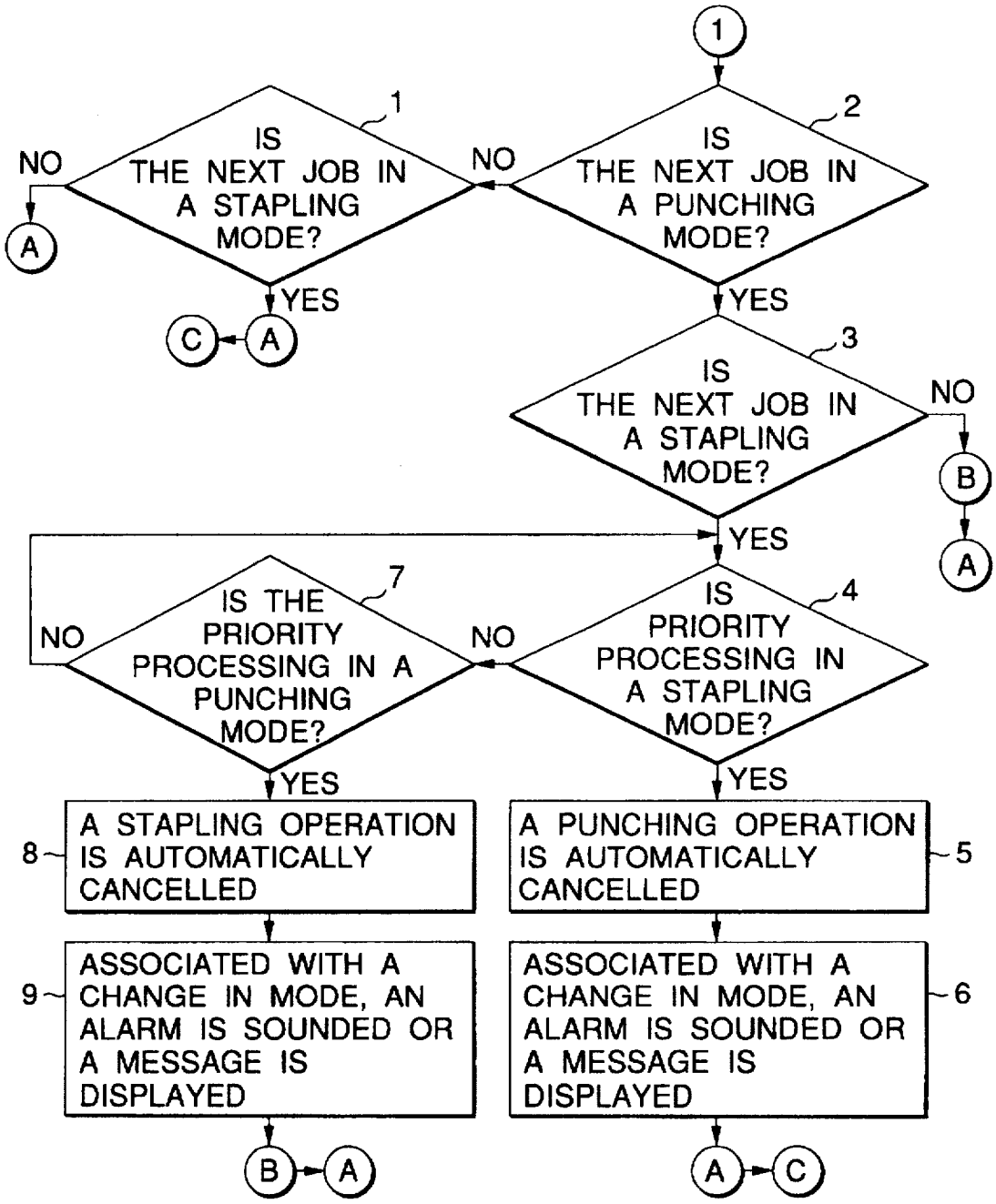
FIG. 13 is a second flowchart showing processing processes of the sheet postprocessing apparatus according to the first embodiment.
Figure 14:
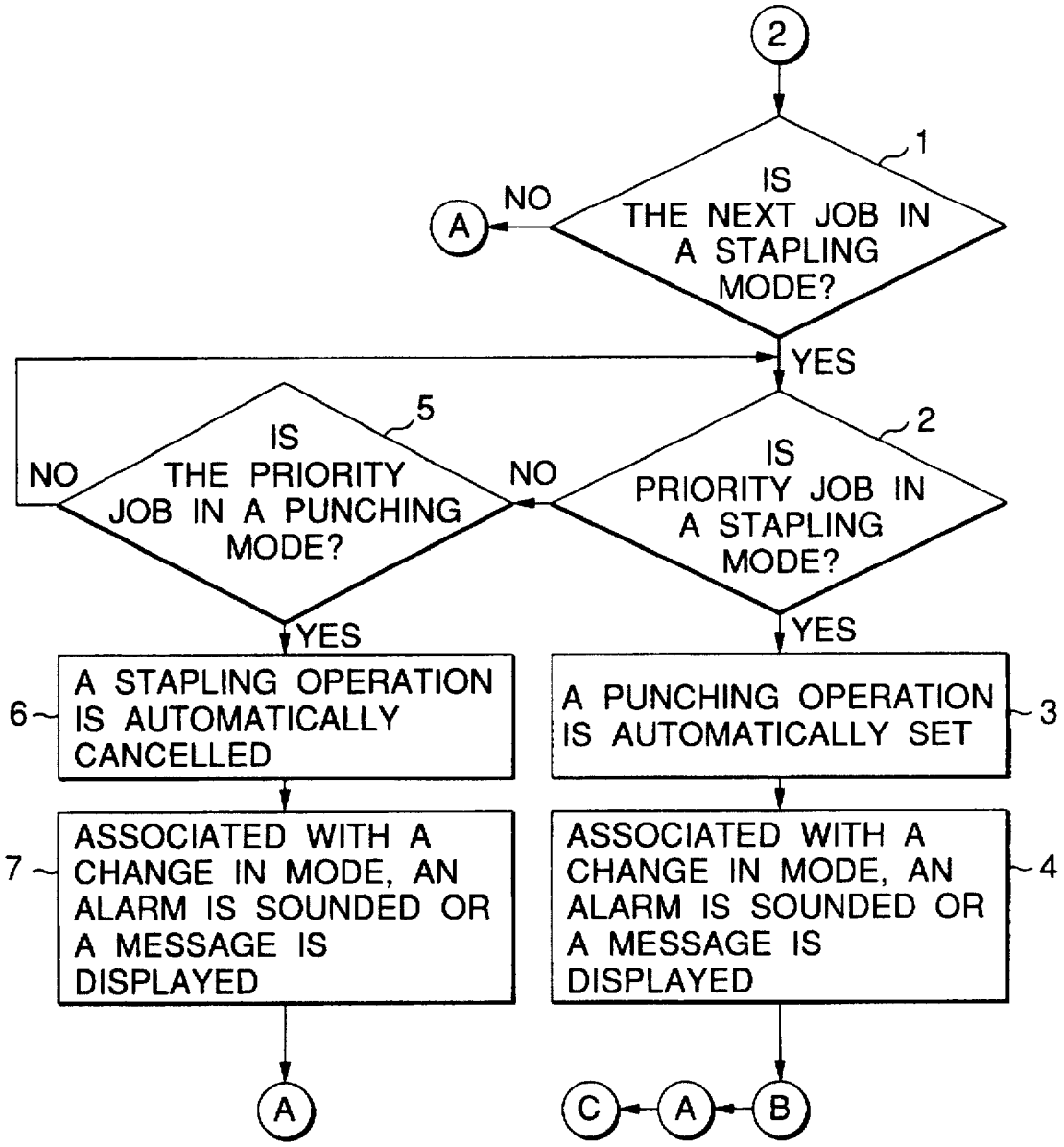
FIG. 14 is a third flowchart showing processing processes of the sheet postprocessing apparatus according to the first embodiment.

FIGS. 12 to 14 are flowcharts showing details on postprocessing operations of the postprocessing apparatus of the present embodiment.

In FIG. 12, a preceding job storage device is an allocated memory location of the RAM shown in FIG. 11. The details of the postprocessing operations of the preceding job instructed from the control panel 30 [e.g., a punching mode (execution of a punching operation), and a stapling mode (execution of a stapling operation)] are stored in that preceding job storage device.

To begin with, whether or not the preceding job is in a punching mode is checked. If the preceding job is in the punching mode, it will be checked whether or not the next job instructed from the control panel 30 is in a punching mode. If the next job is in the punching mode, it will be further checked whether or not the next mode is also in a stapling mode. If the next mode is in a stapling mode, the next job will be sequentially subjected to a punching operation (B), a sorting operation (A), and a stapling operation (C). In contrast, if the next job does not involve the stapling mode, the next job will be sequentially subjected to the punching operation (B) and the sorting operation (A).

Figure 15:
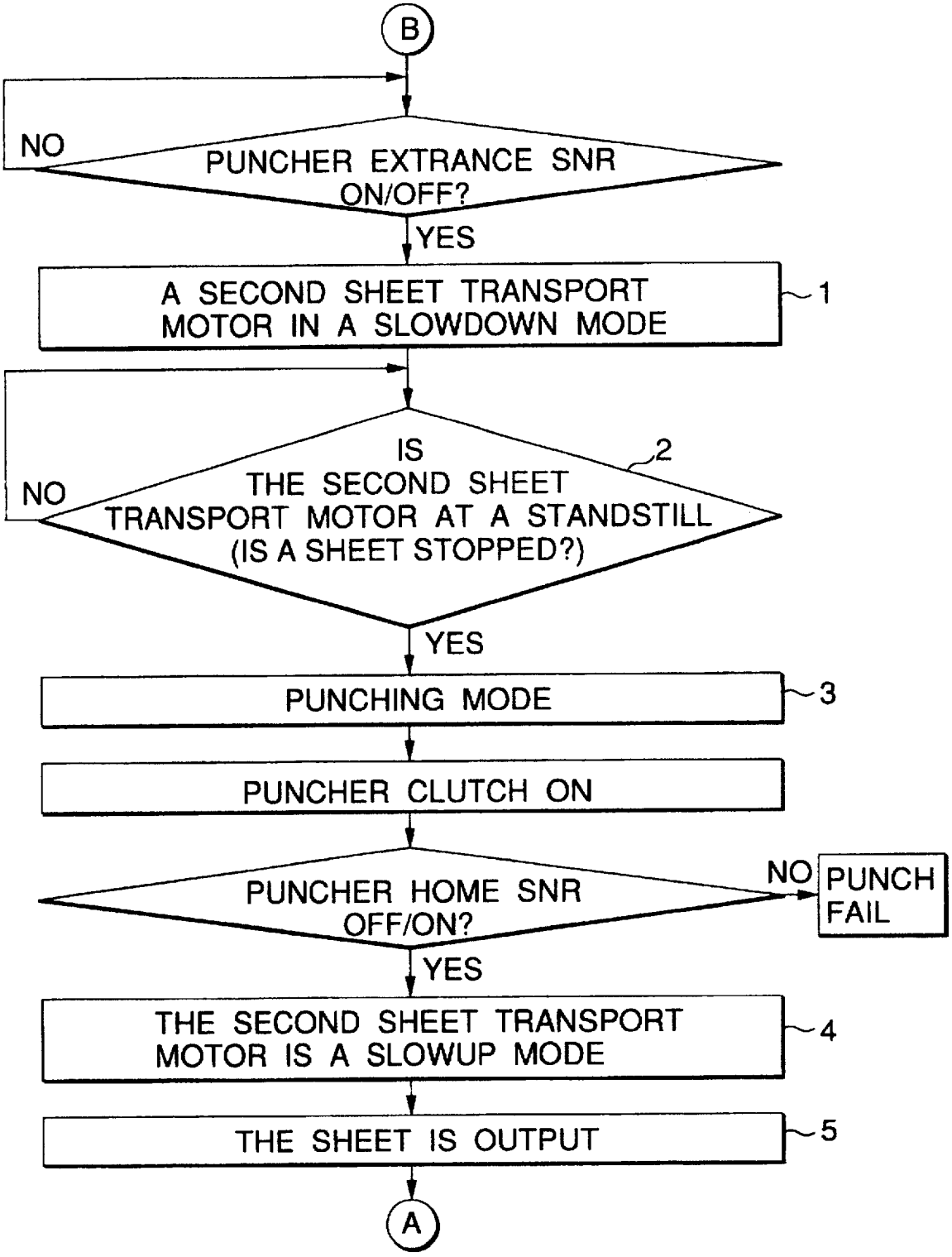
FIG. 15 is a flowchart showing punching processes according to the first embodiment.

The punching operation (B) is executed according to the flowchart shown in FIG. 15. More specifically, when the front end of the sheet passes the puncher entrance sensor 143 (shown in FIG. 5), the puncher entrance sensor 143 is turned off. Then, the second sheet transport motor 621 is set to a slowdown mode and comes into a standstill. The sheet is stopped at the puncher 51.

If the punching mode is set, and the puncher clutch 92 (shown in FIGS. 7A and 7B) is turned on in this condition, the punch pin 85 will carry out a punching operation.

Turning on of the puncher home sensor 144 (shown in FIG. 7A) results in return of the punch pin 85 to its home position, whereby the completion of the punching operation is detected.

As described above, upon detection of the completion of the punching operation, the second sheet transport motor 621 is set to a slowup mode. The sheet in a stop condition starts to travel again. The sheet is output to the sort-bin tray 50.

If the puncher home sensor 144 has failed to detect the completion of the punching operation, a punch failure (PUNCH FAIL) will be displayed.

Figure 16:
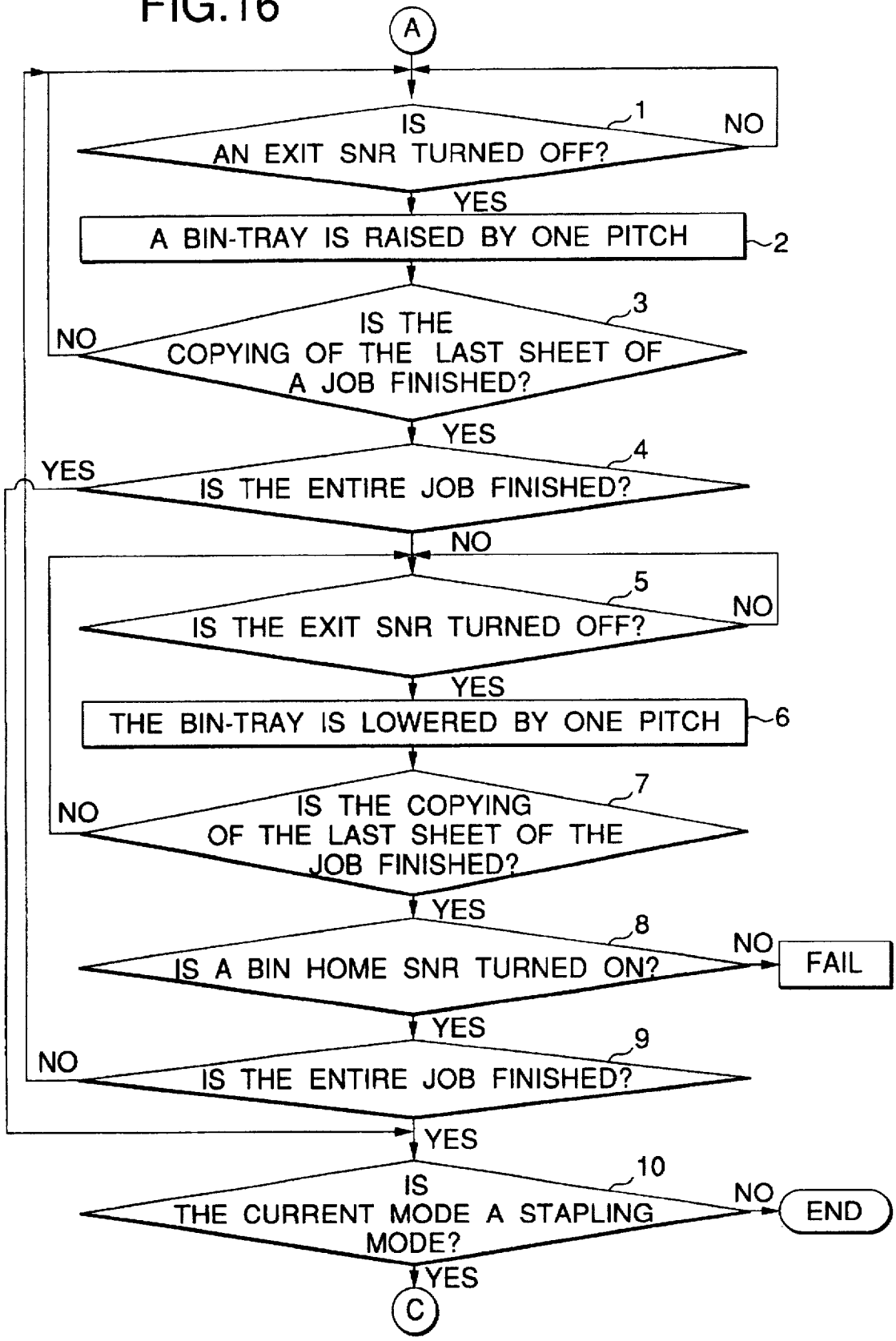
FIG. 16 is a flowchart showing sorting processes according to the first embodiment.

The sorting operation (A) is executed according to the flowchart shown in FIG. 16.

More specifically, when the sheet passes the output sensor 132 (shown in FIG. 5), the output sensor 132 is turned off.

At this moment, the bin motor 63 (shown in FIG. 5) is actuated on a unit basis, whereby each sort-bin tray 50 is raised only by one pitch. It is checked whether or not the copying of the last sheet of the job has been completed.

Subsequently, If the copying of the last sheet of the job has not been completed yet, the previously-described operations will be repeated. When the copying of the last sheet of the job is completed, it is checked whether or not the entire job, that is, the copying of the entire original, has been completed.

If the copying of the entire job has not been completed yet, the bin motor 63 will be actuated on a unit basis when the output sensor 132 is turned off. As a result, each sort-bin tray 50 is lowered by only one pitch, it is checked whether or not the copying of the last sheet of the job has been completed.

If the copying of the last sheet of the job has not been completed yet, the processing for steps S5 to S7 will be repeated. When the copying of the last sheet of the job is completed, it is checked whether or not the bin home sensor 135 (shown in FIG. 5) is turned on. Thereafter, it is checked whether or not the copying of the entire job is completed. If it is decided that the copying of the entire job has not been finished yet, processing will return to the first step again, and the sequence of the aforementioned operations will be carried out.

Through the above-described processing operations, if the copying of the entire job is determined to be completed in step S4 or S9, the sequence of the sorting operations will be terminated.

Further, if it is determined in step 8 that the bin home sensor 135 is not turned on, an indication of failure (FAIL) will be displayed.

Then, it is checked whether or not the current mode is in the stapling mode. If this is so, processing will return to the stapling operation.

Figure 17:
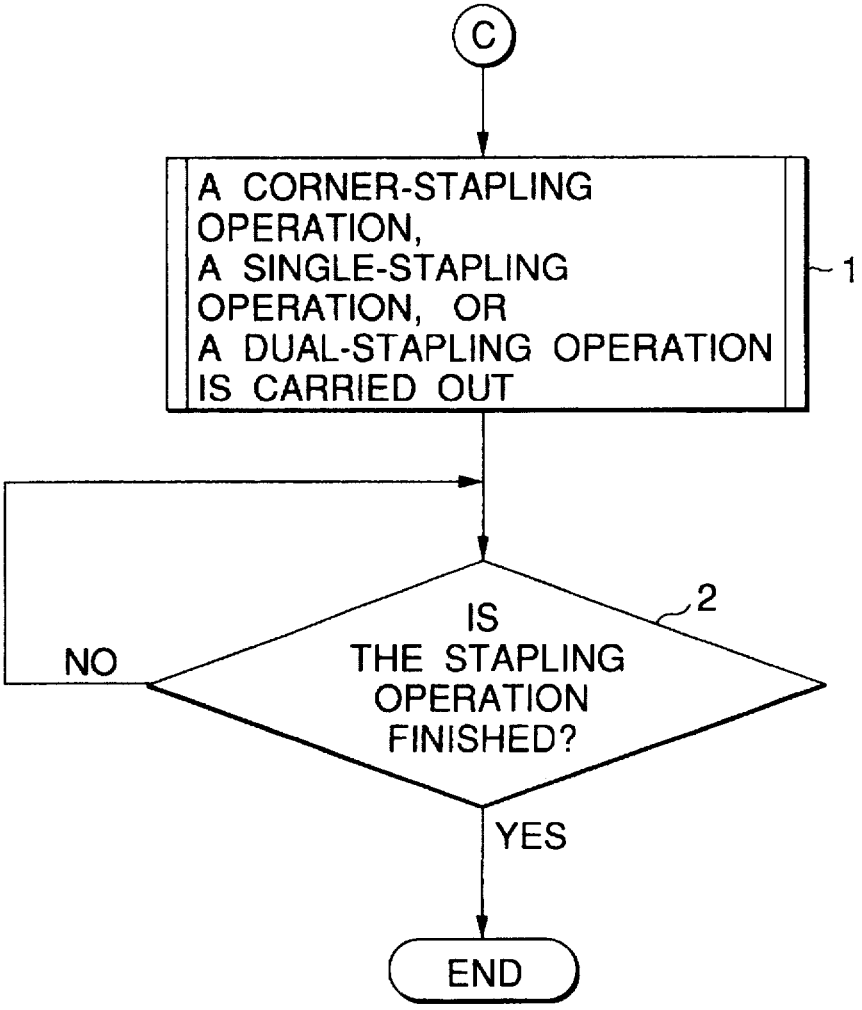
FIG. 17 is a flowchart showing stapling processes according to the first embodiment.
Figure 18:
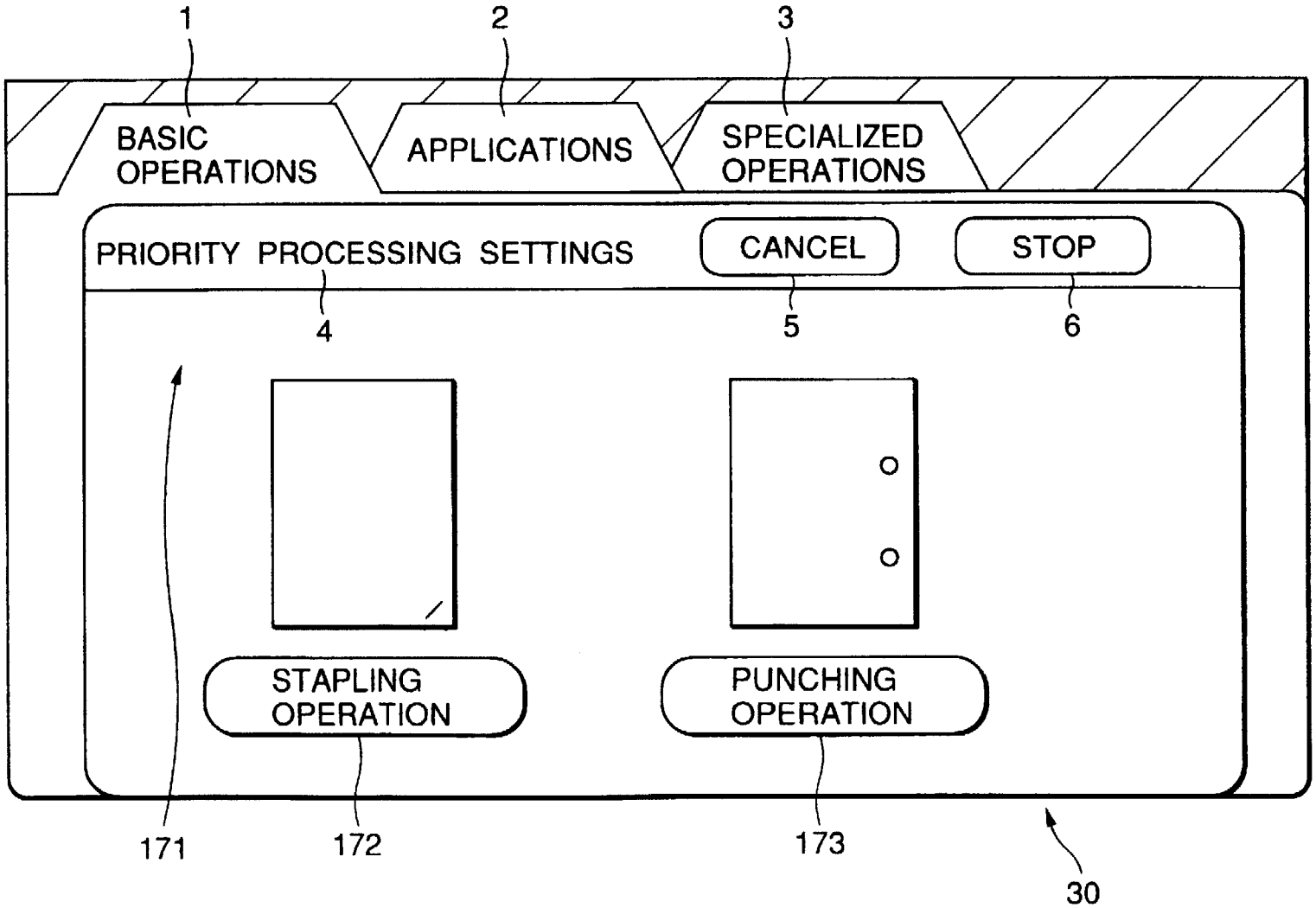
FIG. 18 is an illustrative representation of the settings of priority processing according to the first embodiment.

The stapling operation (C) is carried out according to the flowchart shown in FIG. 17.

The type of sapling mode instructed from the control panel 30, more specifically, any one of the corner-stapling mode, the single-stapling mode, and the dual-stapling mode, is executed. The sequence of operations are completed at the time when the stapler has finished performing the stapling operation.

Specific processing operations related to the corner-stapling mode, the single-stapling mode, and the dual-stapling mode are disclosed in, e.g., the Unexamined Japanese Patent Application Publication No. Hei. 4-257496.

If it is determined that the preceding job is not in the punching mode in FIG. 12, processing will then return to the flowchart shown in FIG. 13.

In this drawing, it is checked whether or not the next job is in a punching mode. If the next job is not in the punching mode, it will be checked whether or not the next job is in a stapling mode. If this is so, the sorting operation (A) and the stapling operation (C) will be sequentially executed. In contrast, if the next job is not in the stapling mode, only the sorting operation (A) will be executed.

Further, if the next job is in the punching mode, it will be checked whether or not the next job is also in a stapling mode. If this is not the case, the punching operation (B) and the sorting operation (A) will be sequentially executed.

In contrast, if the next job is in the stapling mode, it will be checked whether priority processing is set to the stapling mode or the punching mode.

The priority processing is previously set by the user. In the present embodiment, the user sets which of a stapling operation 172 and a drilling operation (corresponding to the punching operation) is prioritized, on a priority processing setting screen 171 of the control panel 30 on the copier main unit 20.

On the assumption that the priority processing is set to the stapling mode (i.e., the stapling operation is prioritized), the punching operation is automatically canceled. Associated with a change in mode, an alarm is sound or a message is displayed. Thereafter, the sorting operation (A) and the stapling operation (C) are sequentially carried out.

Provided that the priority processing is set to the punching mode (i.e., the punching mode is prioritized), the stapling operation is automatically canceled. Associated with a change in mode, an alarm is sound or a message is displayed. Thereafter, the punching operation (B) and the sorting operation (A) are sequentially carried out.

Figure 19:
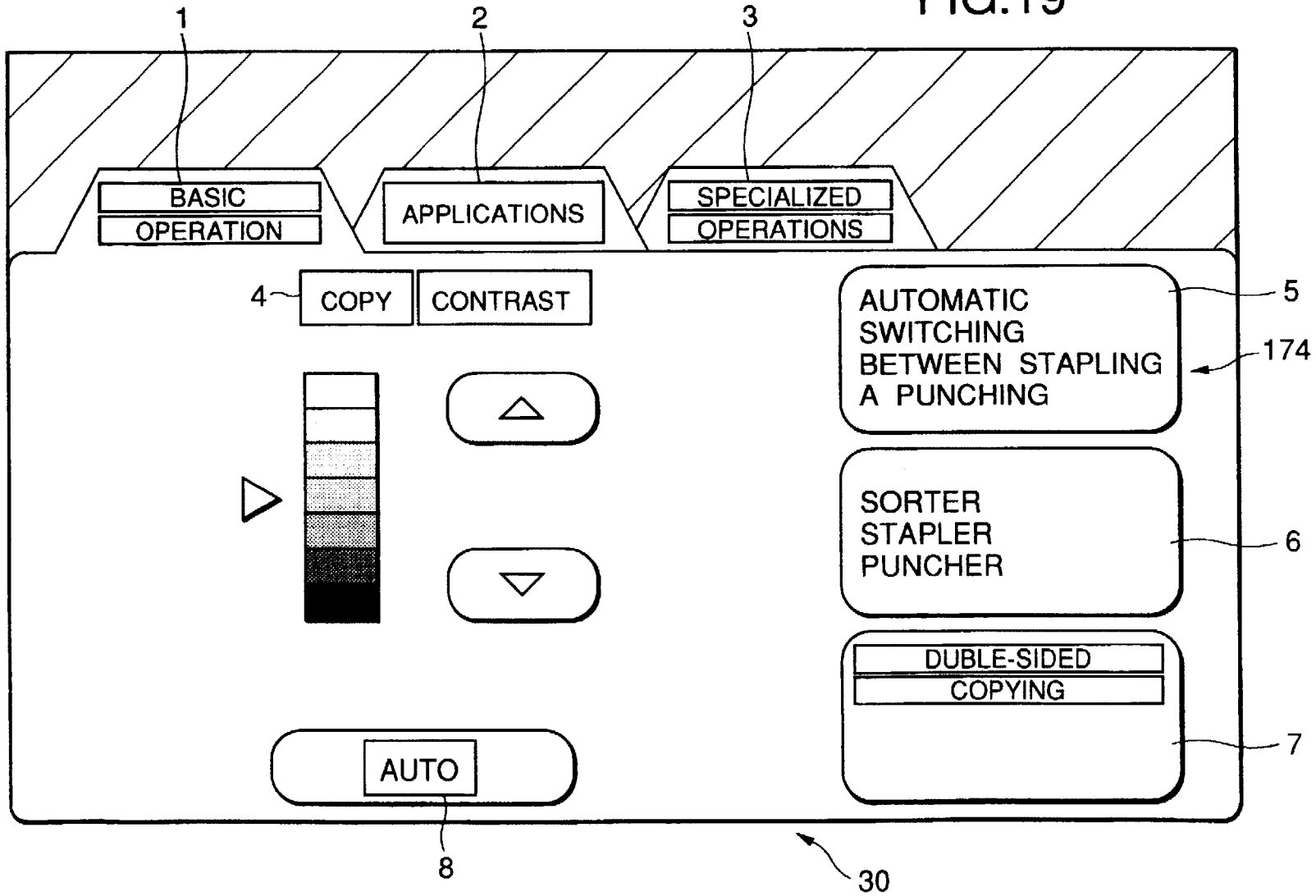
FIG. 19 is an illustrative representation showing an example of warning signs associated with a change in mode according to the first embodiment.

The alarm or the message associated with a change in mode is informed by highlighting an indication 174 "Automatic Changing between Stapling/Punching" in the control panel 30 in the present embodiment, as shown in FIG. 19.

If the next job is decided not to be in the punching mode in FIG. 12, processing will proceed to the flowchart shown in FIG. 14.

In this drawing, it is checked whether or not the next job is in a stapling mode. If this is not the case, only the sorting operation (A) will be executed.

In contrast, if the next job is in the stapling operation, it will be checked whether the priority job is set to the stapling mode or the punching mode.

On the assumption that the priority job is set to the stapling mode (i.e., the stapling mode is prioritized), the punching operation will be automatically set. Associated with a change in mode, an alarm is sound or a message is displayed. Thereafter, the punching operation (B), the sorting operation (A), and the stapling operation (C) are sequentially carried out.

Further, provided that the priority job is set to the punching mode (i.e., the punching operation is prioritized), the stapling operation is automatically canceled. Associated with a change in mode, an alarm is sound or a message is displayed. Thereafter, only the sorting operation (A) is carried out.

If the previously-described priority processing method is employed, it will become possible to effectively prevent, at least, execution of the stapling operation while the sheets of the preceding job and the sheets of the next job which are different from each other with regard to the punching state, are mixed together.

(Second Embodiment)

In contrast with the first embodiment, the second embodiment is directed to the present invention applied to a postprocessing apparatus capable of carrying out punching operations which are different from each other with respect to the number of holes (i.e., two holes or three holes).

FIGS. 20A to 22 show a puncher of the second embodiment.

Figure 20A:
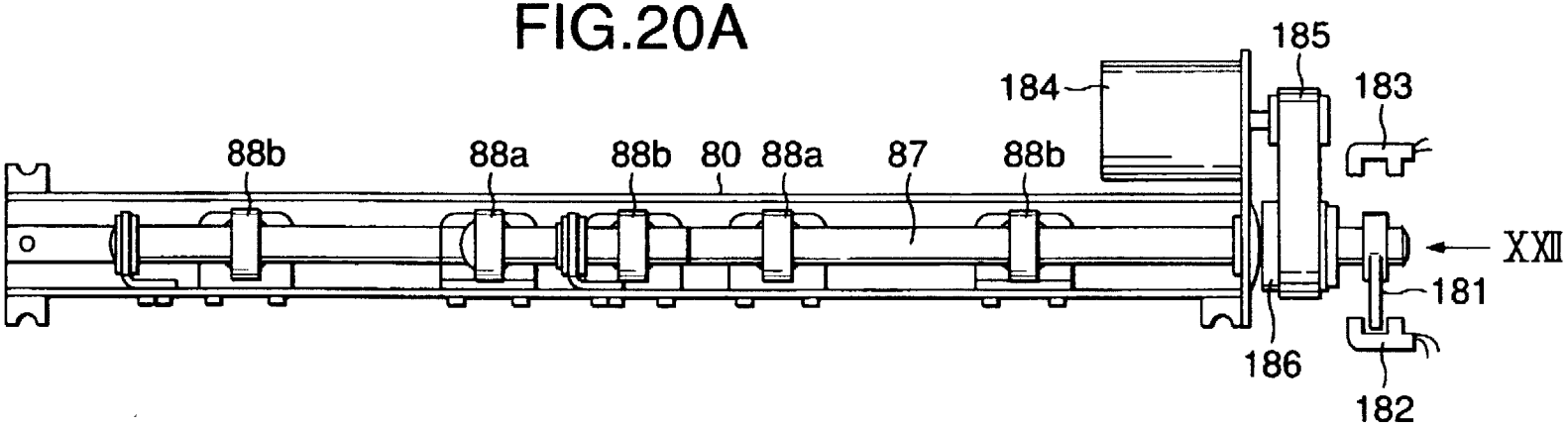
FIG. 20A is an illustrative plan view of a puncher according to a second embodiment.
Figure 20B:
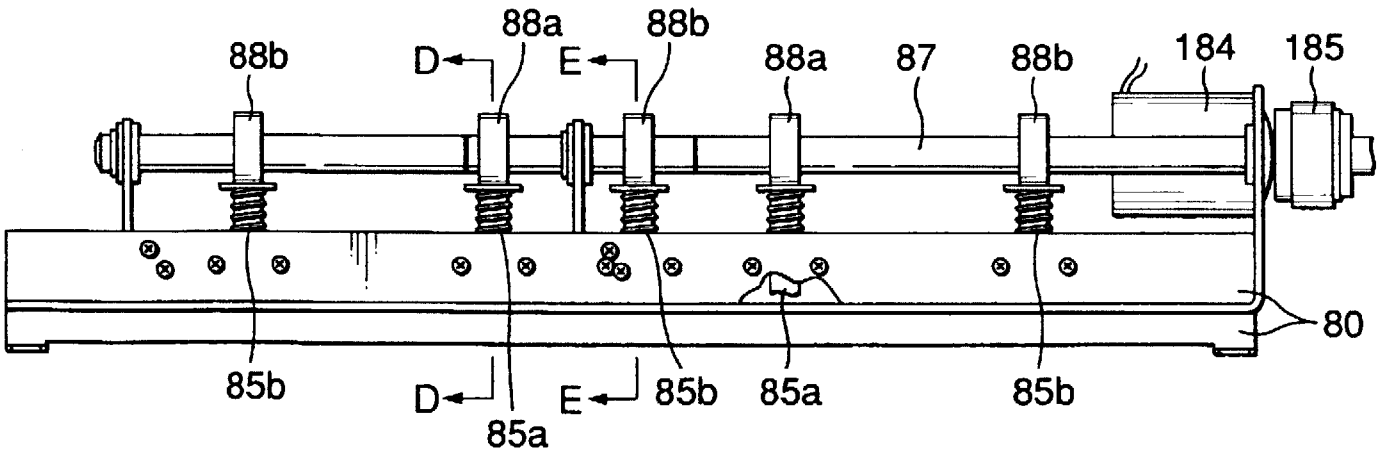
FIG. 20B is an illustrative front view of the puncher.
Figure 21A:
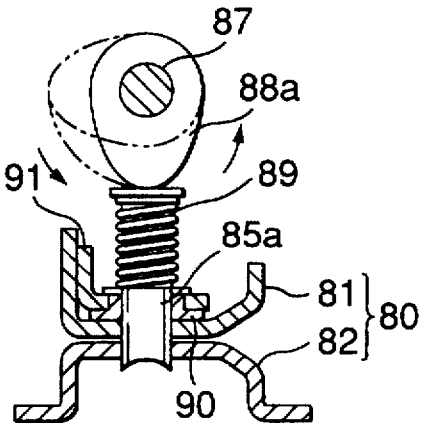
FIG. 21A is an illustrative schematic representation showing the details of two-hole punch pins.
Figure 21B:
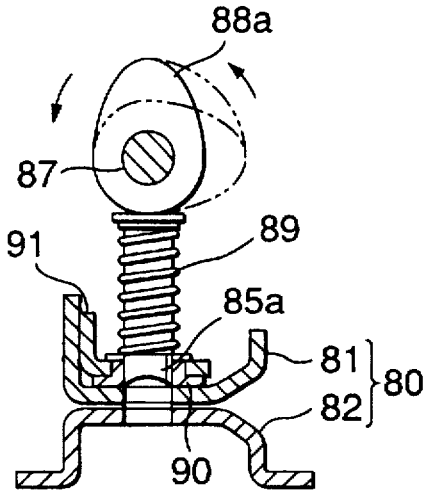
FIG. 21B is an illustrative schematic representation showing the details of three-hole punch pins.
Figure 22:
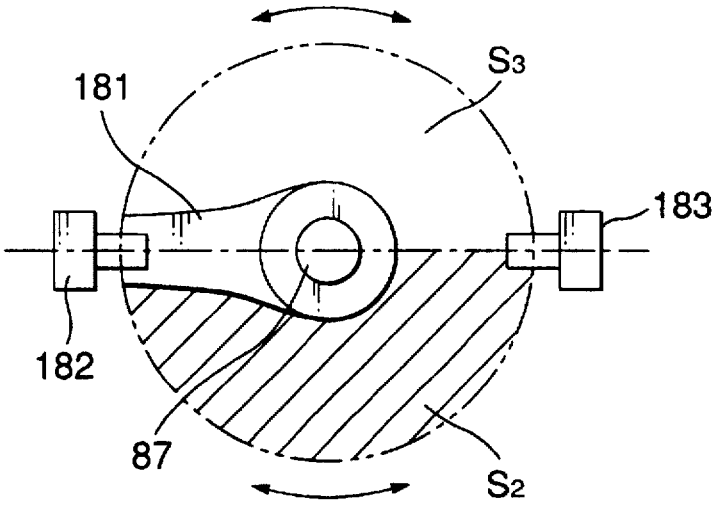
FIG. 22 is a schematic representation showing a method of actuating the two-hole punch pins and the three-hole punch pins according to the second embodiment.

FIG. 20A is an illustrative plan view of a puncher according to a second embodiment, and FIG. 20B is an illustrative front view of the puncher. FIG. 21A is a cross-sectional view of the puncher taken across line D—D shown in FIG. 20B, and FIG. 21B is a cross-sectional view of the puncher taken across line E—E shown in FIG. 20B. FIG. 22 is a side end view of the puncher when viewed in the direction designated by arrow XXII shown in FIG. 20A.

In these drawings, the puncher 51 has a pair of chute frames 80 (corresponding to the chute frame 81 and 82 of the first embodiment) that form a sheet transport path. The through holes 83 and 84 are opened in each of the chute frames so as to correspond to predetermined punching positions (two holes and three holes in the present embodiment). Punch pins 85*a* (for two-hole punching purposes) and 85*b* (for three-hole punching purposes) that freely pass through the through holes 83 and 84 are positioned above the through holes 83 of the chute frame 81. These punch pins 85*a* and 85*b* travel back and forth between a withdrawal position and a protruded position. More specifically, the punch pins 85*a* and 85*b* retract to the withdrawal position which is spaced away from the transport path formed between the chute frames 81 and 82, as well as completely protruding through the through holes 83 and 84 to the protruded position.

A mechanism to move the punch pins 85*a* and 85*b* back and forth is substantially the same as the corresponding mechanism of the first embodiment (the elements that are the same as those of the elements of the first embodiment are assigned the same reference numerals, and their detailed explanations will be omitted here.). However, in contrast with the first embodiment, substantially ellipsoidal eccentric cams 88*a* and 88*b*, each of which has its portion bulged, are fitted around the shaft 87 so as to correspond to the punch pins 85*a* and 85*b* while the eccentric cams 88*a* and 88*b* are, for example, 180° apart from each other, as shown in FIGS. 21A and 21B. For example, where the two-hole punching operation is carried out, it is only necessary to arrange the two-hole eccentric cams 88*a* so as to rotate through 180° such that they return to the withdrawal position after having pressed down the punch pins 85*a* using their bulging cam surfaces. Where the three-hole punching operation is carried out, it is only necessary to arrange the three-hole eccentric cams 88*b* so as to rotate through 180° such that they return to the withdrawal position after having pressed down the punch pins 85*b* using their bulging cam surfaces.

In a case where the punching operation is carried out using the two-hole punch pins 85*a*, as shown in FIG. 21A, the circular portions of the three-hole eccentric cams 88*b* are in contact with the heads of the punch pins 85*b*, as shown in FIG. 21B, and hence the three-hole punch pins 85*b* remain in the withdrawal position.

Conversely, in a case where the punching operation is carried out using the three-hole punch pins 85*b*, the two-hole punch pins 85*a* remain in the withdrawal position.

In the present embodiment, a light-shielding plate 181 is attached to one end of the shaft 87 so as to protrude in a radial direction of the shaft, as shown in FIG. 22. A pair of punch home sensors 182, 183 are disposed so as to be 180° apart from each other along the circular path of the leading edge of the light-shielding plate 181. If the light-shielding plate 181 crosses either the punch home sensor 182 or 183, the punch home sensor 182 or 183 will be turned on.

At this time, in the case of the two-hole punching operation, the light-shielding plate 181 is controlled so as to rotate one-half turn within only a hatched area S2 between the punch home sensors 182 and 183 (i.e., a lower semicircular area). Further, in the case of the three-hole punching operation, the light-shielding plate 181 is controlled so as to rotate one-half turn within only an unhatched area S3 between the punch home sensors 182 and 183 (i.e., an upper semicircular area).

A drive force of a specifically-designed drive motor 184 consisting of a pulse motor capable of rotating in forward and reverse directions is transmitted to the shaft 87 by way of a timing belt 185 and a pulley 186.

Figure 23:
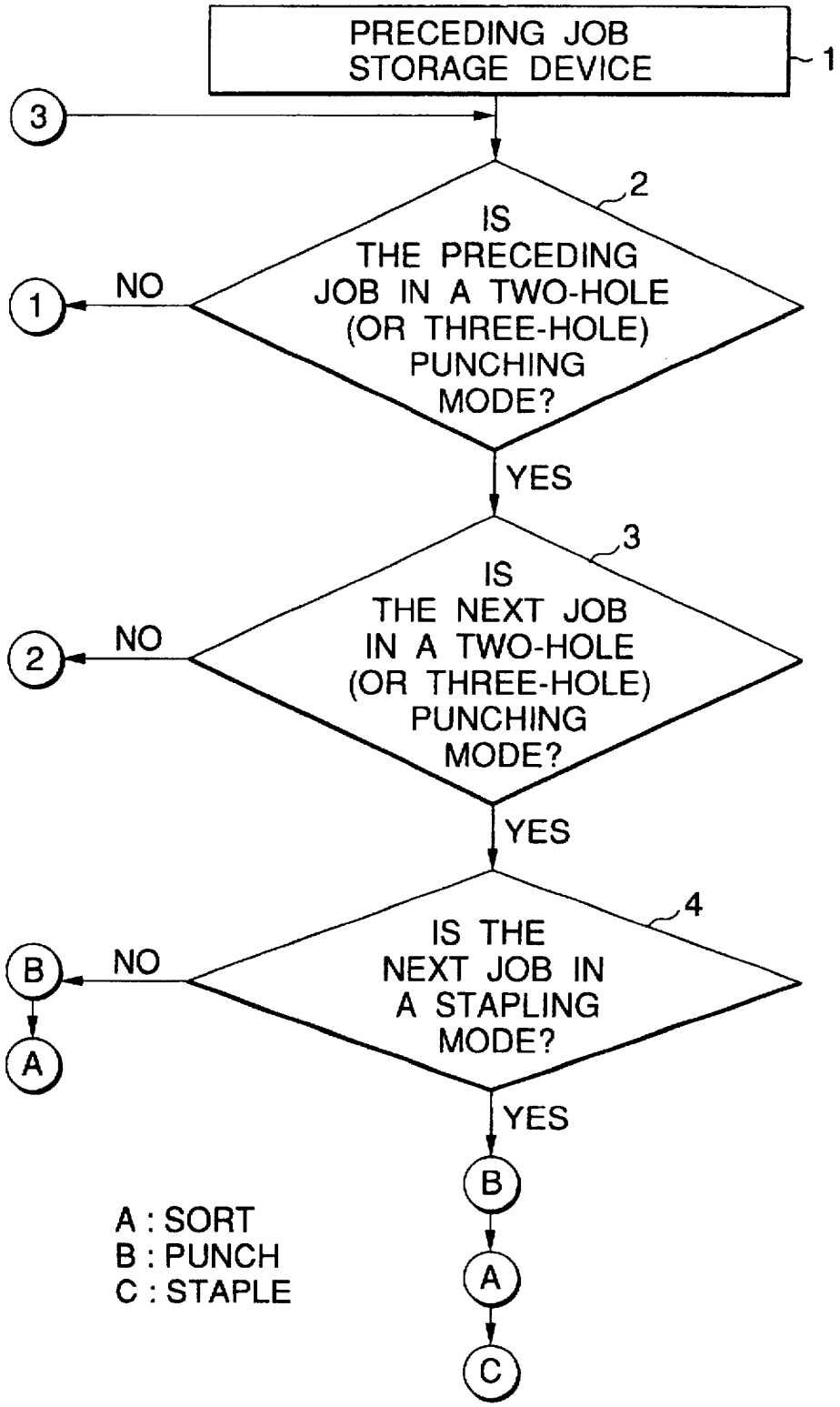
FIG. 23 is a first flowchart showing processing processes of the sheet postprocessing apparatus according the second embodiment.
Figure 24:
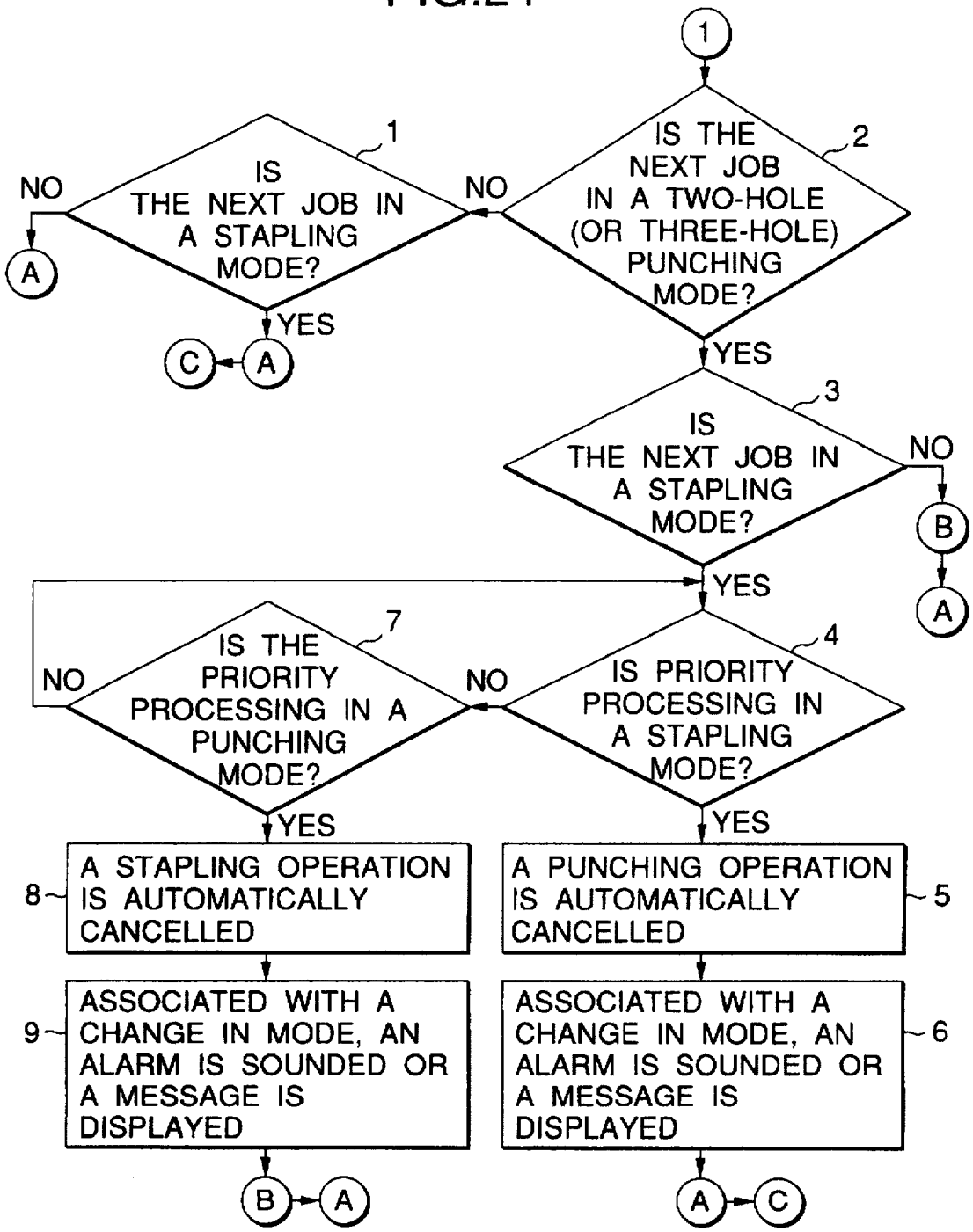
FIG. 24 is a second flowchart showing processing processes of the sheet postprocessing apparatus according to the second embodiment.
Figure 25:
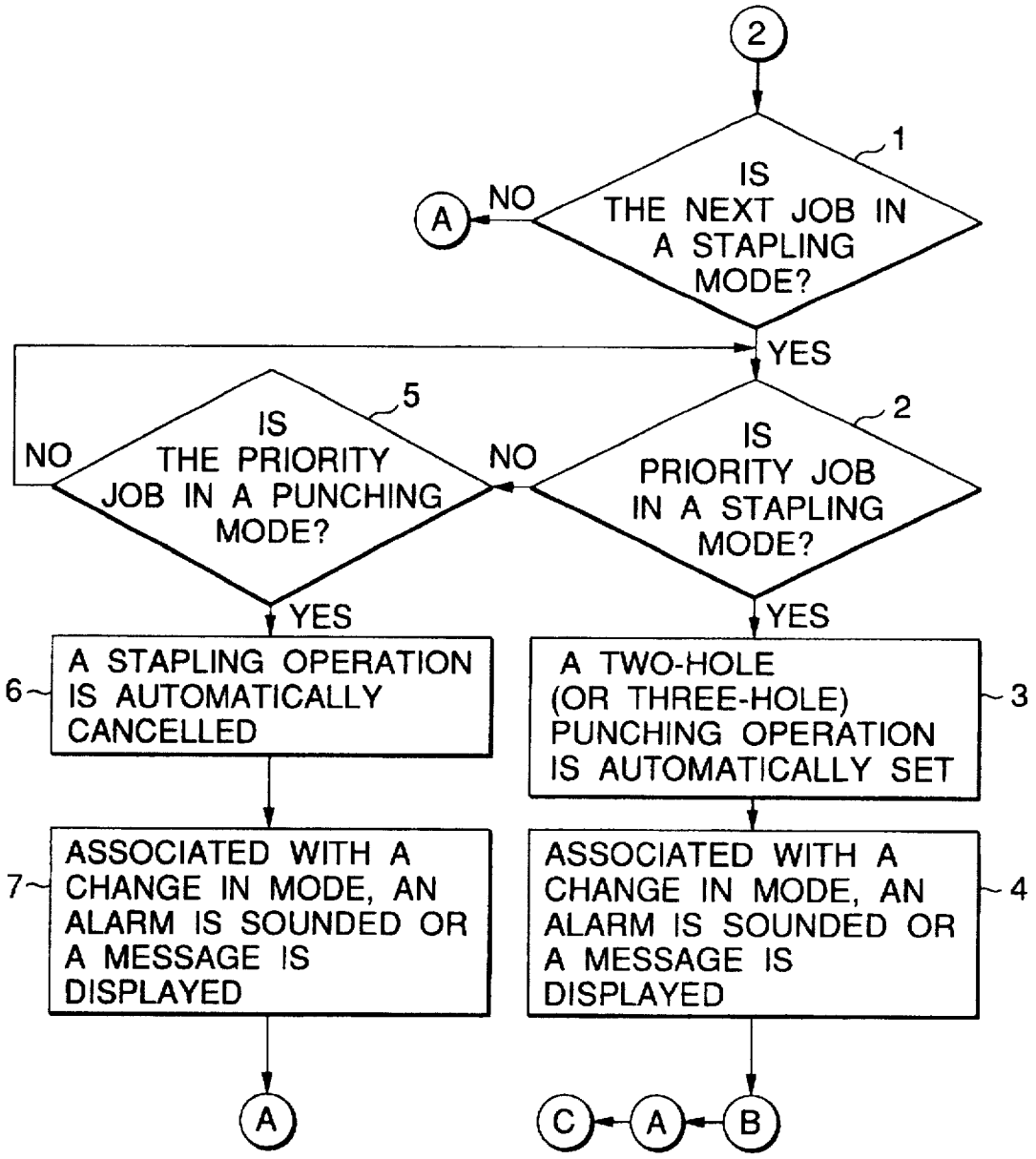
FIG. 25 is a third flowchart showing processing processes of a sheet postprocessing apparatus according to a third embodiment.

FIGS. 23 to 25 are flowcharts showing details on the postprocessing operation of the postprocessing apparatus of the second embodiment.

In FIG. 23, the preceding job storage device is an allocated memory location of the RAM shown in FIG. 11. This preceding job storage device holds data on the details of the postprocessing of the preceding job instructed from the control panel 30 [e.g., a punching mode (including execution of a punching operation and information about the number of holes) and a stapling mode (execution of the stapling operation)].

These flowcharts are, in principle, the same as those of the first embodiment substantially. However, in contrast with the first embodiment, it is necessary to determine whether the "punching mode" of the first embodiment is the "two-hole punching mode" or the "three-hole punching mode." A decision as to whether the punching mode is the two-hole punching mode or the three-hole punching mode is previously made on the basis of the information stored in the preceding job storage device. The puncher 51 is designed so as to carry out either the two-hole punching or three-hole punching operation according to the mode.

(Third Embodiment)

In contrast with the first embodiment, the third embodiment is directed to the present invention applied to a postprocessing apparatus capable of carrying out punching operations which are different from each other with regard to the position of holes.

Figure 26A:
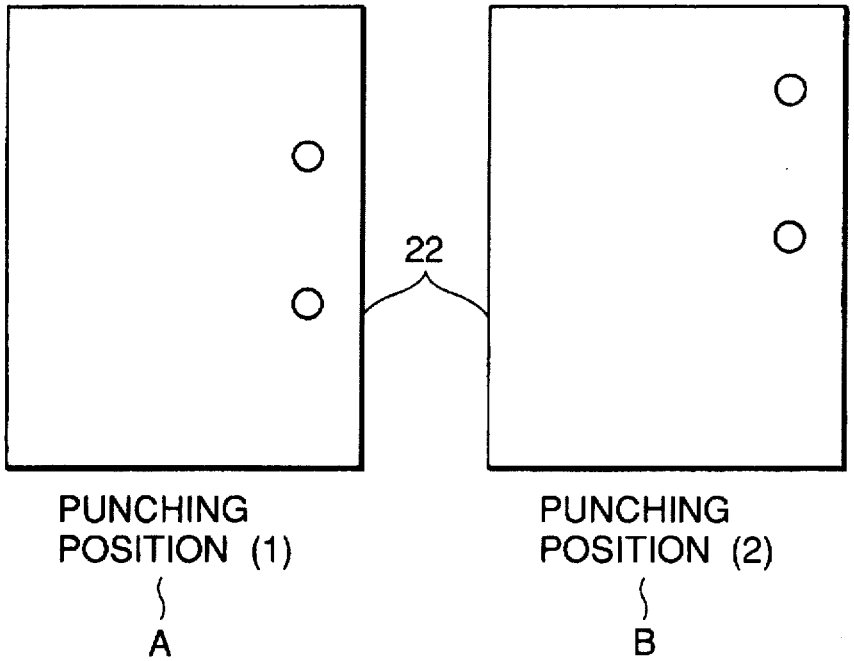
FIG. 26A is an illustrative representation showing the position of holes punched by the sheet postprocessing apparatus according to the third embodiment.
Figure 26B:
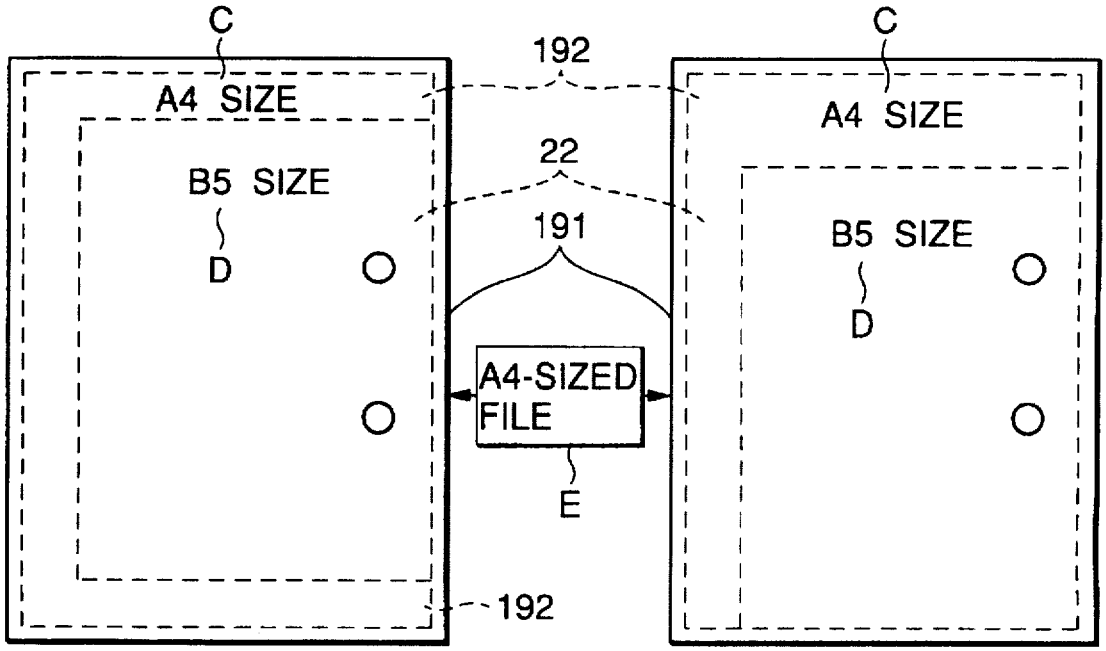
FIG. 26B is an illustrative representation for describing the reason why sheets having holes punched in different positions are necessary.

A punching position (1) designates a case where the sheet 22 is punched as a result of a sensor-based sorting operation, as shown in FIG. 26A. In this case, if the punched sheet 22 which is a B5-sized LEF is arranged in a A4-sized file 191, as shown in FIG. 26B, clearance 192 will arise in the upper and lower areas of the file 191.

In contrast, according to a punching position (2), the punching position of the sheet 22 is changed to prevent the above-described problem, as shown in FIG. 26A. If the sheet 22 which is the B5-sized LEF is arranged in the A4-sized file 191, as shown in FIG. 26B, the file 191 and the sheet 22 will have their bottoms leveled with each other.

Such a filing manner is effective in arranging a mixture of A4-sized sheets and B5-sized sheets into one file. The number of users who prefer this type of filing operation becomes increased.

Figure 27A:
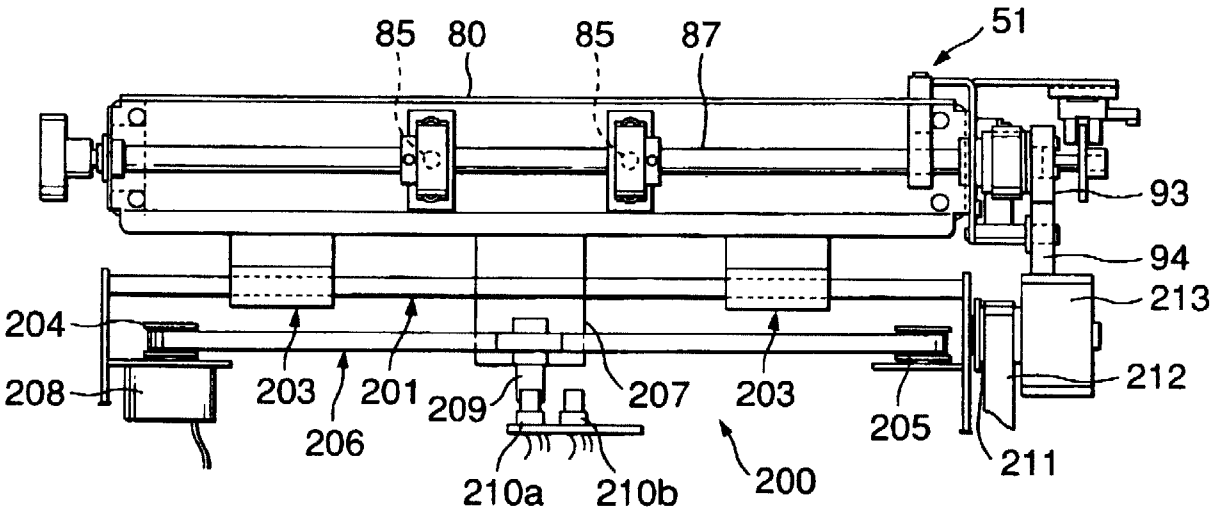
FIG. 27A is an illustrative plan view of a puncher according to the third embodiment.
Figure 27B:
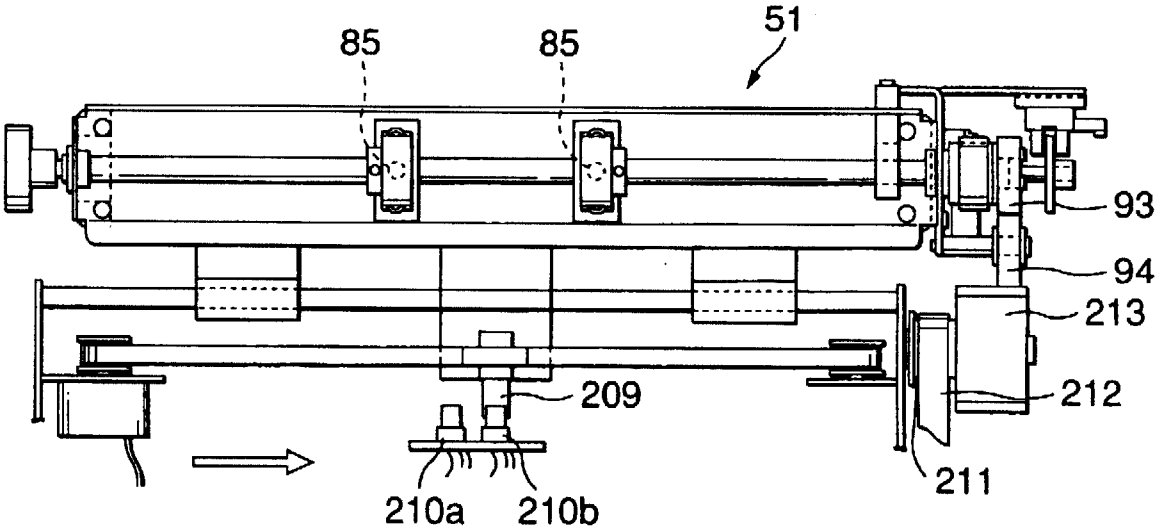
FIG. 27B is an illustrative front view of the puncher.

The puncher of the present embodiment meets the above-described user demand, a specific example of the puncher is shown in FIGS. 27A and 27B.

FIG. 27A is an illustrative plan view of the puncher of the third embodiment before it travels, and FIG. 27B is an illustrative front view of the puncher after it has traveled.

In these drawings, the puncher 51 is, in principle, the same as the puncher of the first embodiment in construction. In contrast with the first embodiment, the puncher 51 travels along the shaft 87 by means of a movable support mechanism 200, as required, so that the punching positions of the punch pins 85 (two holes in the third embodiment) are changed.

The elements that are the same as those of the first embodiment are assigned the same reference numerals, and their detailed explanations will be omitted here.

The movable support mechanism 200 is provided with a slide rod 201 which is disposed in parallel with the shaft 87. The chute frame 80 of the puncher 51 is provided with, e.g., a pair of slide retaining members 203, and these slide retaining members 203 are slidably fitted around the slide rod 201. Further, a pair of pulleys 204 and 205 are disposed in parallel with the slide rod 201, and a drive force transmission belt 206 is wrapped around these pulleys 204 and 205. A joint member 207 connects the drive force transmission belt 206 with the chute frame 80 of the puncher 51. The pulley 204 is rotated by a puncher drive motor 208, whereby the puncher 51 travels along the slide rod 201.

A positioning member 209 is attached to the drive force transmission belt 206 or the joint member 207. Position sensors 210*a* and 210*b* are previously located along the travel path of the positioning member 209 so as to correspond to the punching positions. When the positioning member 209 arrives at either the positioning sensor 210*a* or 201*b*, the puncher drive motor 208 is arranged so as to stop rotating.

In the drawings, reference numerals 211 and 212 designate an intermediate pulley and a drive force transmission belt for use with, e.g., the first sheet transport drive system 61 (see FIG. 5), respectively. A driven gear 213 is coaxially attached to the intermediate pulley 211. This driven gear 213 meshes with the drive force transmission gear 93 via the intermediate gear 94, whereby a drive force of the first sheet transport drive system 61 is transmitted to the shaft 87 by way of the previously-described drive force transmission system.

The driven gear 213 is formed to have a large thickness. Therefore, even if the puncher 51 travels, the driven gear 213 and the intermediate gear 94 will maintain a meshed relationship with each other.

As described above, the punching positions of the punch pins 85 are varied by changing the position of the puncher 51.

Figure 28:
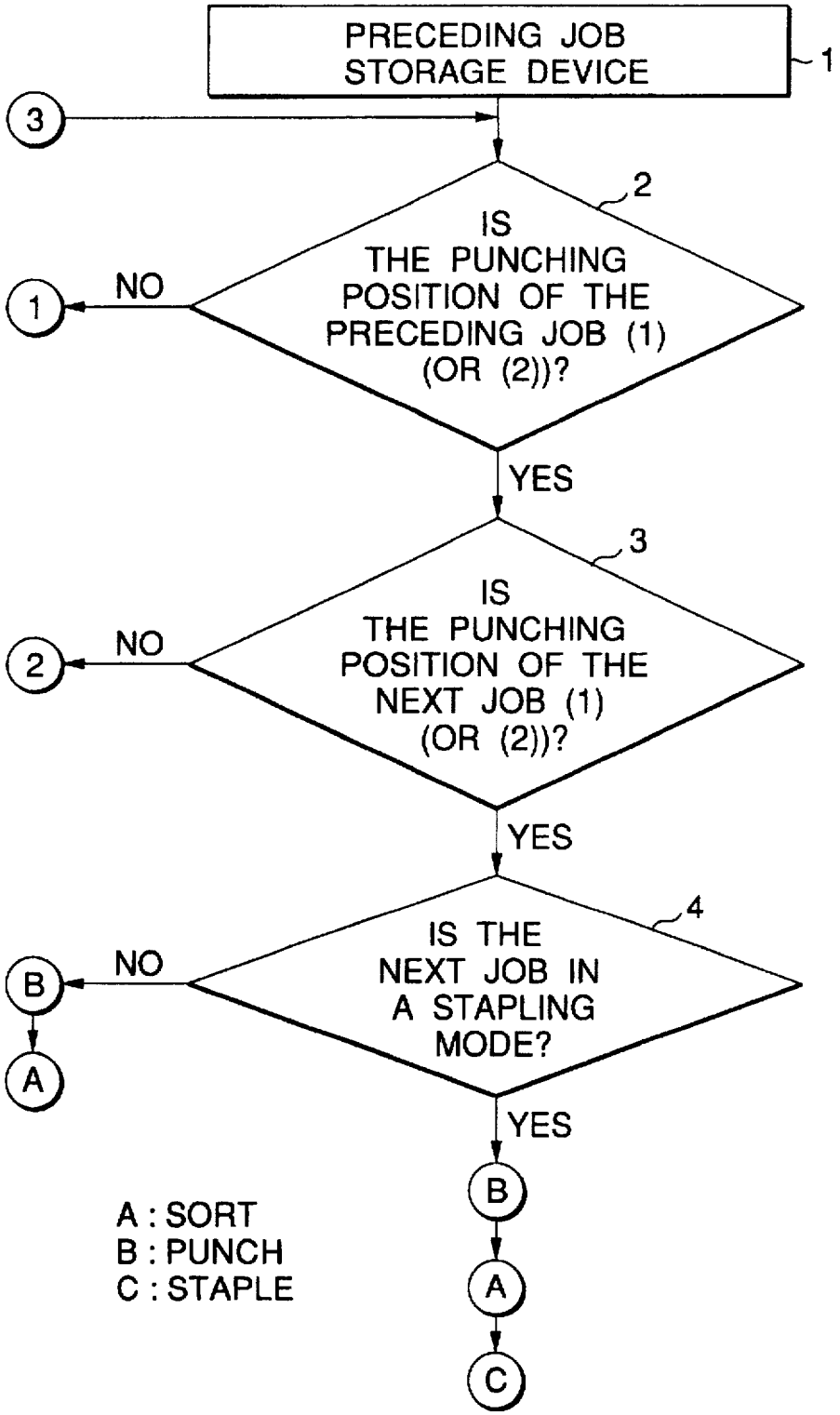
FIG. 28 is a first flowchart showing processing processes of the sheet postprocessing apparatus according to the third embodiment.
Figure 29:
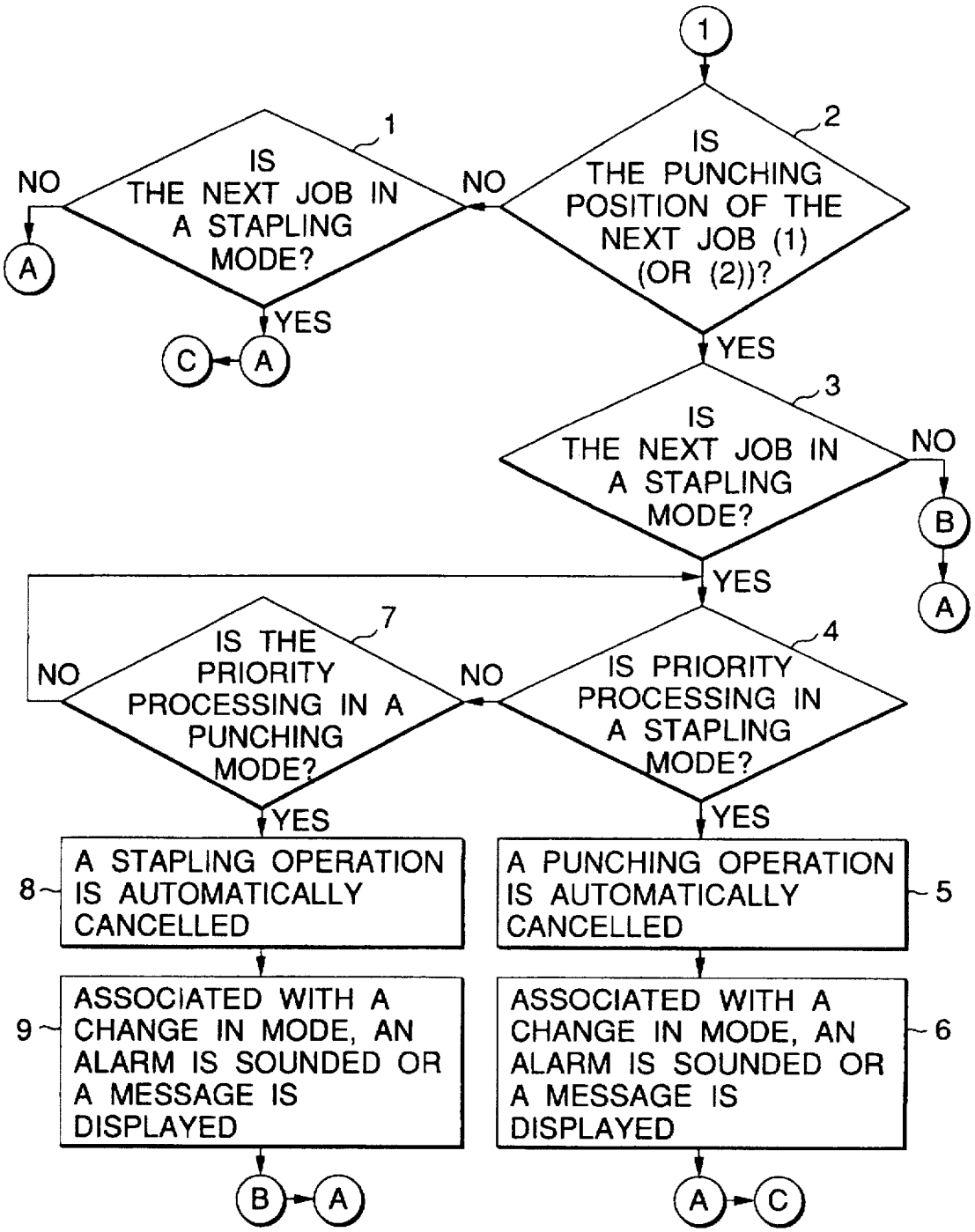
FIG. 29 is a second flowchart showing processing processes of the sheet postprocessing apparatus according to the third embodiment.
Figure 30:
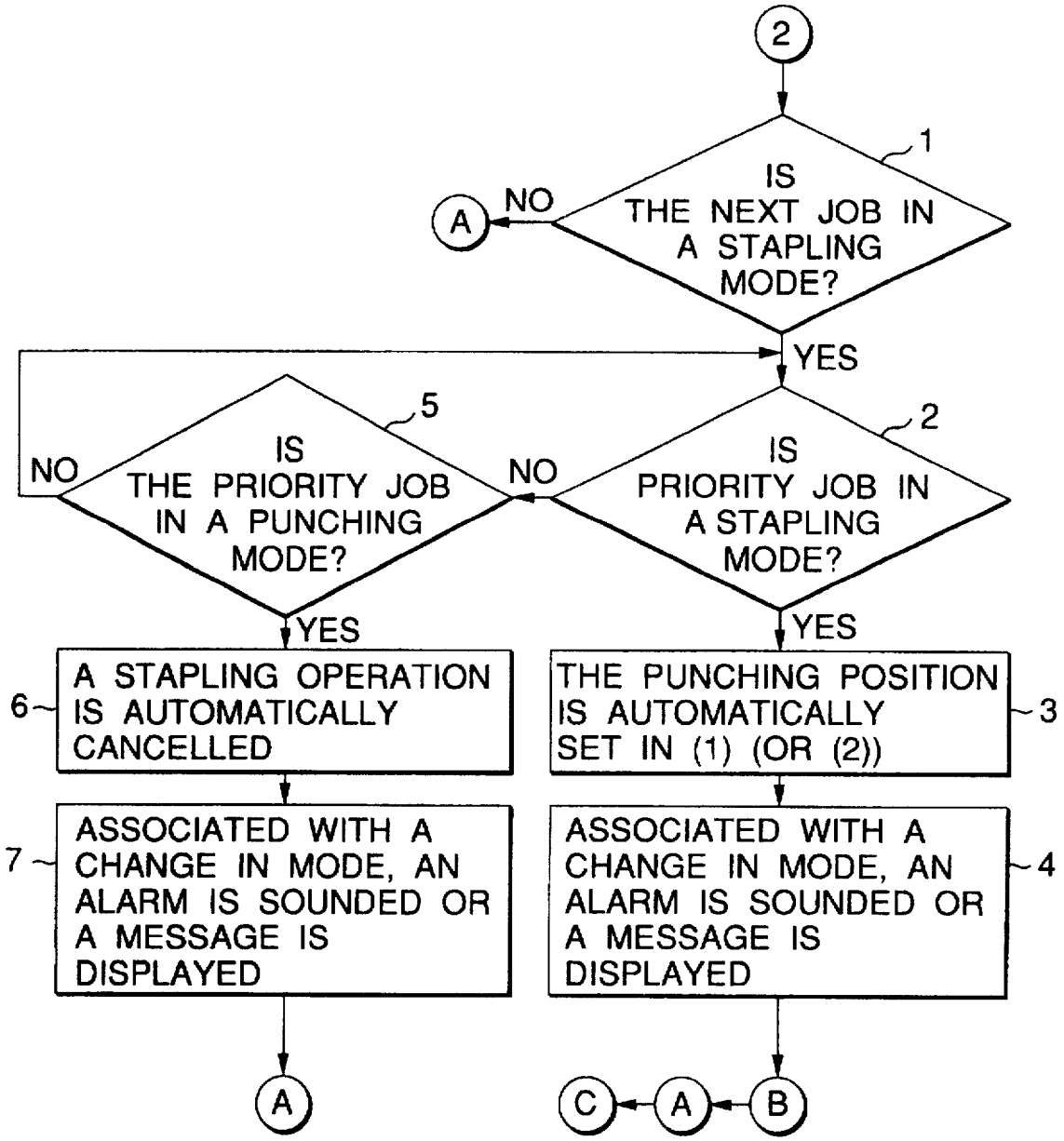
FIG. 30 is a third flowchart showing processing processes of the sheet postprocessing apparatus according to the third embodiment.

FIGS. 28 through 30 are flowcharts showing details on the postprocessing operation of the postprocessing apparatus according to the third embodiment.

In FIG. 28, the preceding job storage device is an allocated memory location of the RAM shown in FIG. 11. This preceding job storage device holds data on the details of the postprocessing of the preceding job instructed from the control panel 30 [e.g., a punching mode (including execution of a punching operation and information about the number of holes) and a stapling mode (execution of the stapling operation)].

These flowcharts are, in principle, the same as those of the first embodiment substantially. However, in contrast with the first embodiment, it is necessary to determine whether the "punching mode" of the first embodiment is a "punching mode (1)" or a "punching mode (2)."

The punching modes (1) and (2) correspond to the punching positions (1) and (2) shown in FIG. 26A. A decision as to whether the punching mode is the punching position (1) or the punching position (2) is previously made on the basis of the information on the preceding job storage device. The puncher 51 is arranged to carry out the punching operation while its position is adjusted so as to correspond to the punching positions (1) and (2), respectively.

(Fourth Embodiment)

Figure 31:
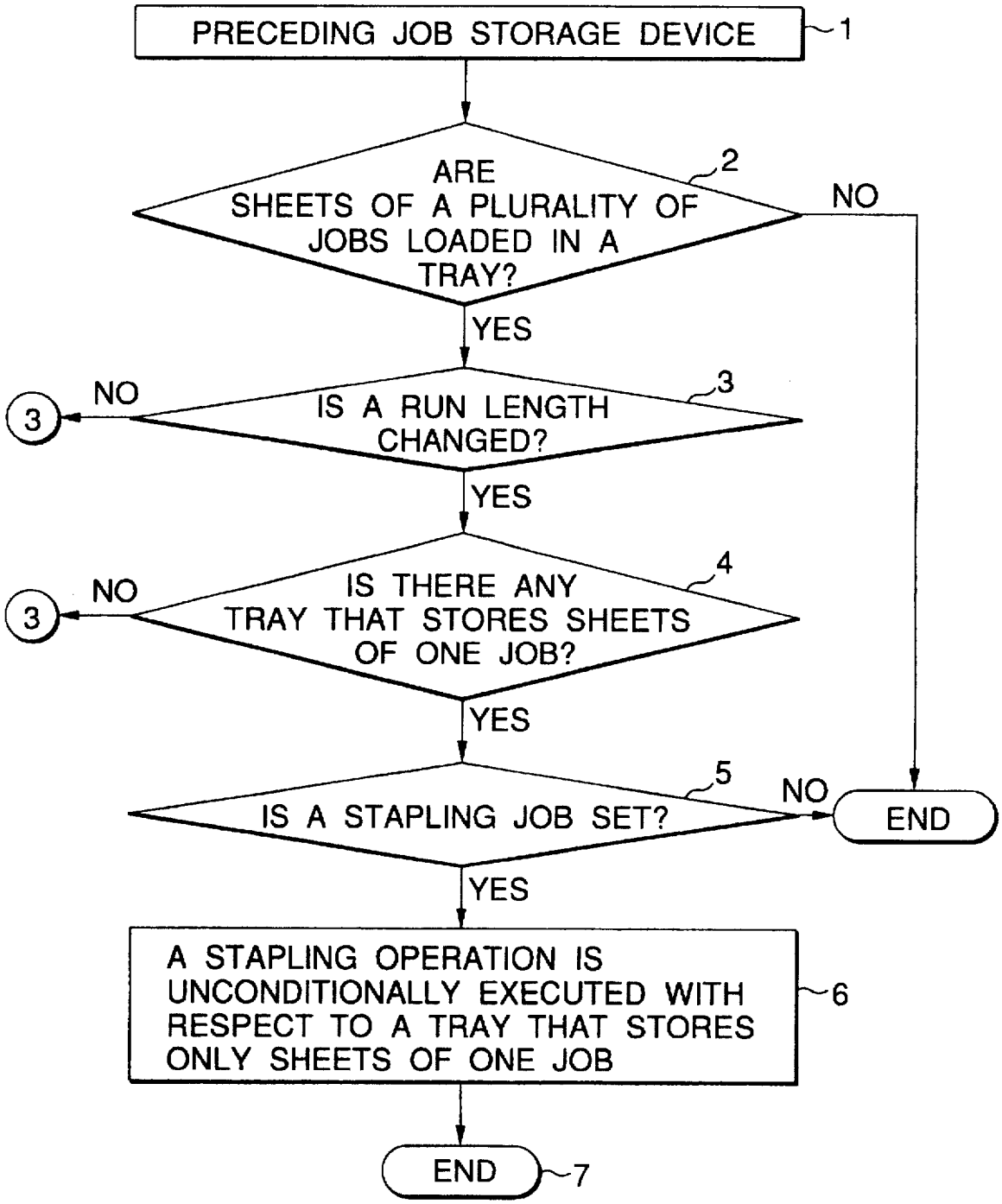
FIG. 31 is a flowchart showing postprocessing of sheets of a single job which is carried out by a sheet postprocessing apparatus according to a fourth embodiment of the present invention.

The present embodiment is substantially the same as the first embodiment. Further, the postprocessing apparatus of the fourth embodiment is arranged so as to be possible to carry out a postprocessing for sheets of a single job, as shown in FIG. 31.

To begin with, it is checked, on the basis of the information stored in the preceding job storage device, whether or not sheets of a plurality of jobs are loaded on the sort-bin tray. If the sheets are loaded in the tray, it will be checked whether or not the number of sorted sheets (R/L: run-length) has been changed between the preceding job and the next job. If the number of sorted sheets has been changed, it will be further checked whether or not there is a sort-bin tray which stores only sheets of one job.

If there is a sort-bin tray which stores only sheets of one job, it will be checked whether or not the sheets are set to a stapling processing. If this is the case, the sort-bin tray that stores only sheets of one job will be unconditionally subjected to the stapling operation.

If there is no change between the preceding job and the next job with regard to the run-length, or if there is no tray which stores sheets of only one job even though there is a change between them with regard to the run-length, processing will return to the first step shown in FIG. 12. Then, the sequence of processing operations are executed.

Further, if sheets of a plurality of jobs are not loaded in the tray, or if the sheets are not set to the stapling operation even though there is a tray which stores sheets of only one job, the postprocessing related to the sheets of only one job shown in FIG. 31 will be immediately terminated.

The postprocessing operation for the sheets of a single job in the present embodiment may be combined with the postprocessing operations of the second and third embodiments.

(Fifth Embodiment)

All the first through fourth embodiments are directed to automatic presetting of the stapling and punching operations. The present embodiment is directed to the present invention applied to a "Manual Stapling Mode" in which only the punching operation is automatically set at the outset, and the stapling operation is set in the end.

Figure 32:
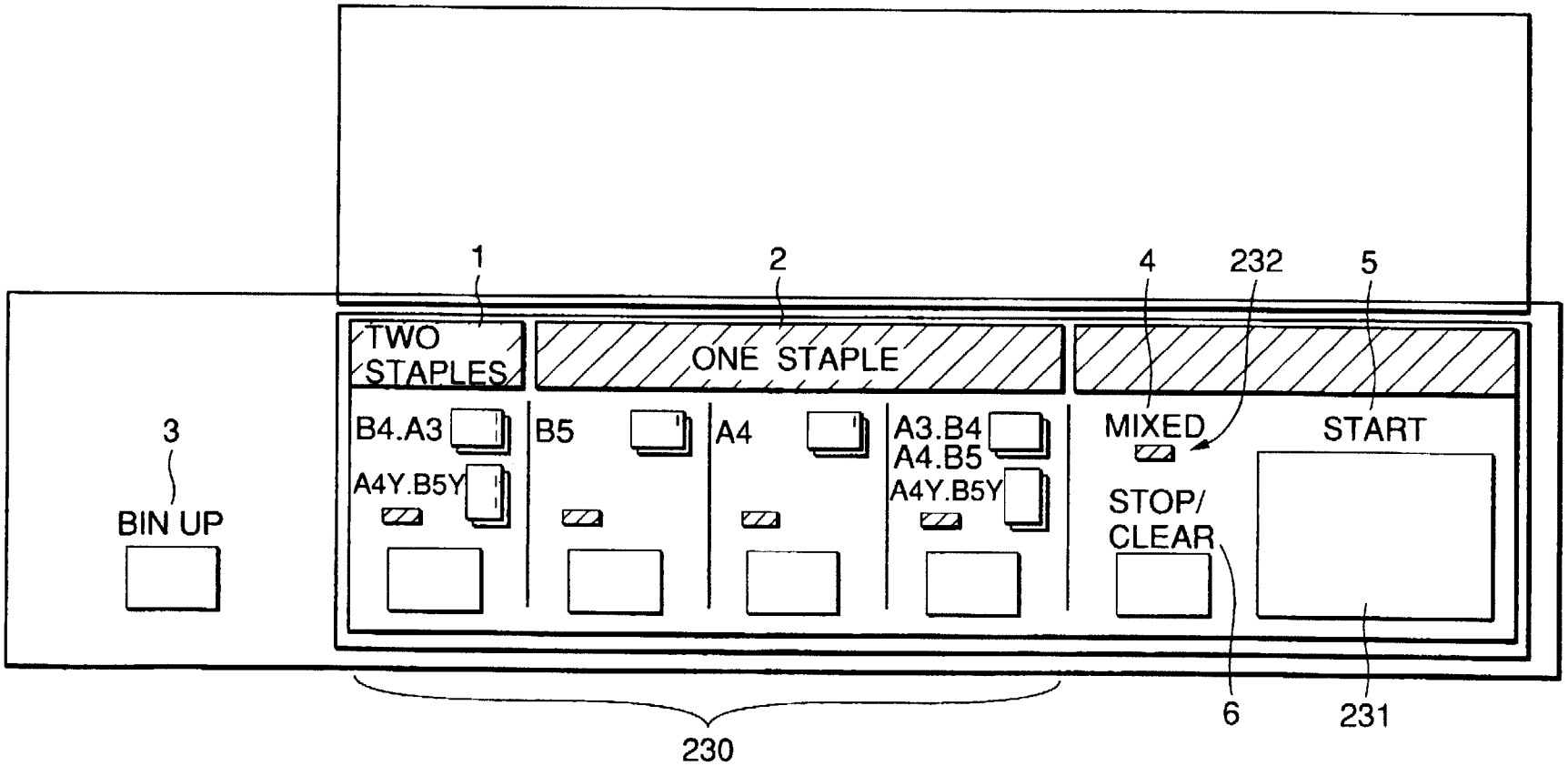
FIG. 32 is an illustrative representation showing a manual stapling operation of a sheet postprocessing apparatus according to a fifth embodiment of the present invention.

FIG. 32 shows the control panel 53 of a postprocessing apparatus 40. Where a manual stapling mode is set, all that needs to be done is to select any one of various stapling modes 230 on the control panel 53 and turn on a start switch 231.

Figure 33:
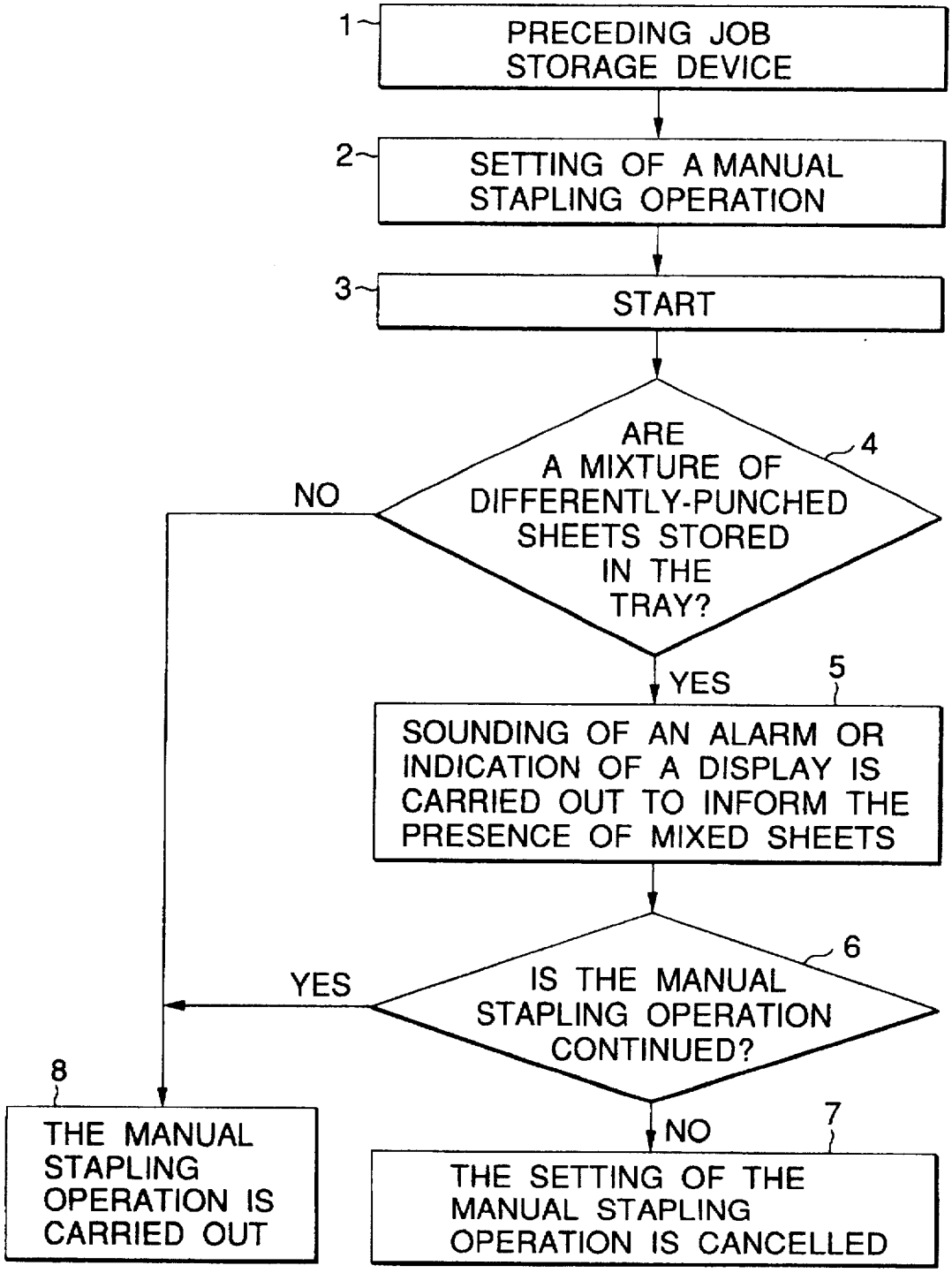
FIG. 33 is a flowchart showing processing processes of the sheet postprocessing apparatus according to the fifth embodiment.

FIG. 33 shows a flowchart related to postprocessing operations for the thus-set manual stapling mode.

In the drawing, if a starting operation is carried out after the manual stapling mode has been set, it will be checked, on the basis of the information stored in the preceding job storage device, whether or not a mixture of differently drilled (i.e., punched) sheets are stored in the sort-bin tray. If this is not the case, the manual stapling mode will be immediately carried out. In contrast, if a mixture of differently-punched sheets are stored, an alarm will be sounded or a message will be displayed.

In the present embodiment, a mixture display lamp 232 is disposed on the top of the control panel 53. When a mixture of differently-punched sheets are stored in the manner as previously described, the mixture display lamp 232 will light up.

As a result, it becomes possible for the user to easily ascertain a foreseeable trouble in which the differently-punched sheets will be stapled, exactly as they are, if the manual stapling mode is now selected, upon glancing at the indication of the mixture display lamp 232.

In the present embodiment, when the mixture display lamp 232 lights up, it will become possible to execute the manual stapling mode if the settings of the manual stapling mode are canceled and the current operation is continued, instead of checking whether or not the manual stapling mode is continued and the continuation of the manual stapling mode is selected.

The "continuation operation" may be effected by various methods, e.g., the turning-on operation of the start switch 213 again.

Therefore, when the mixture display lamp 232 lights up, it is possible to carry out the stapling operation solely with respect to the required sheets after removal of unnecessary sheets from the sort-bin tray.

(Sixth Embodiment)

As is the case of the fifth embodiment, the present embodiment relates to the manual stapling mode. However, in contrast with the fifth embodiment, a postprocessing apparatus of the present embodiment does not employ the preceding job storage device.

Figure 34:
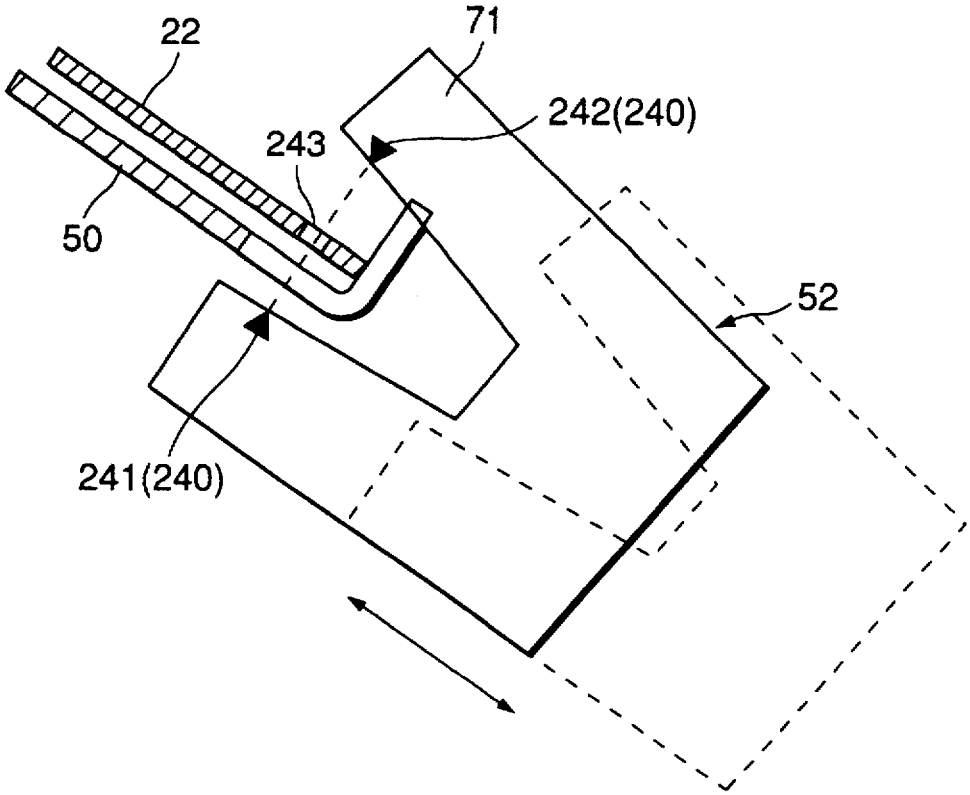
FIG. 34 is an illustrative representation showing an example of the determination of mixed sheets carried out by a sheet postprocessing apparatus according to a sixth embodiment of the present invention.

More specifically, for example, a transmission sensor 240 consisting of a light-emitting element 241 and a light-receiving element 242 which are opposite to each other, is disposed in the opening of the stapler head 71 of the stapler 52, as shown in FIG. 34. The light path of the transmission sensor 240 is set so as to correspond to a punching position 243 of the sheet 22.

With this arrangement, if an output of the transmission sensor 240 is a high, i.e., if the light passes through the punching position 243, it will be possible to determine that a mixture of differently-punched sheets 22 are not stored. In contrast, if the output of the transmission sensor 240 is a low, i.e., the light fails to pass through the punching position 243, it will be possible to determine that a mixture of differently-punched sheets 22 are stored.

Accordingly, the transmission sensor 240 can be utilized as a paper mixture sensor.

Since the transmission sensor (i.e., the paper mixture sensor) 240 is disposed in the stapler head 71, it will become impossible to detect a mixture of sheets unless the stapler head 71 is moved to the stapling position.

Figure 35:
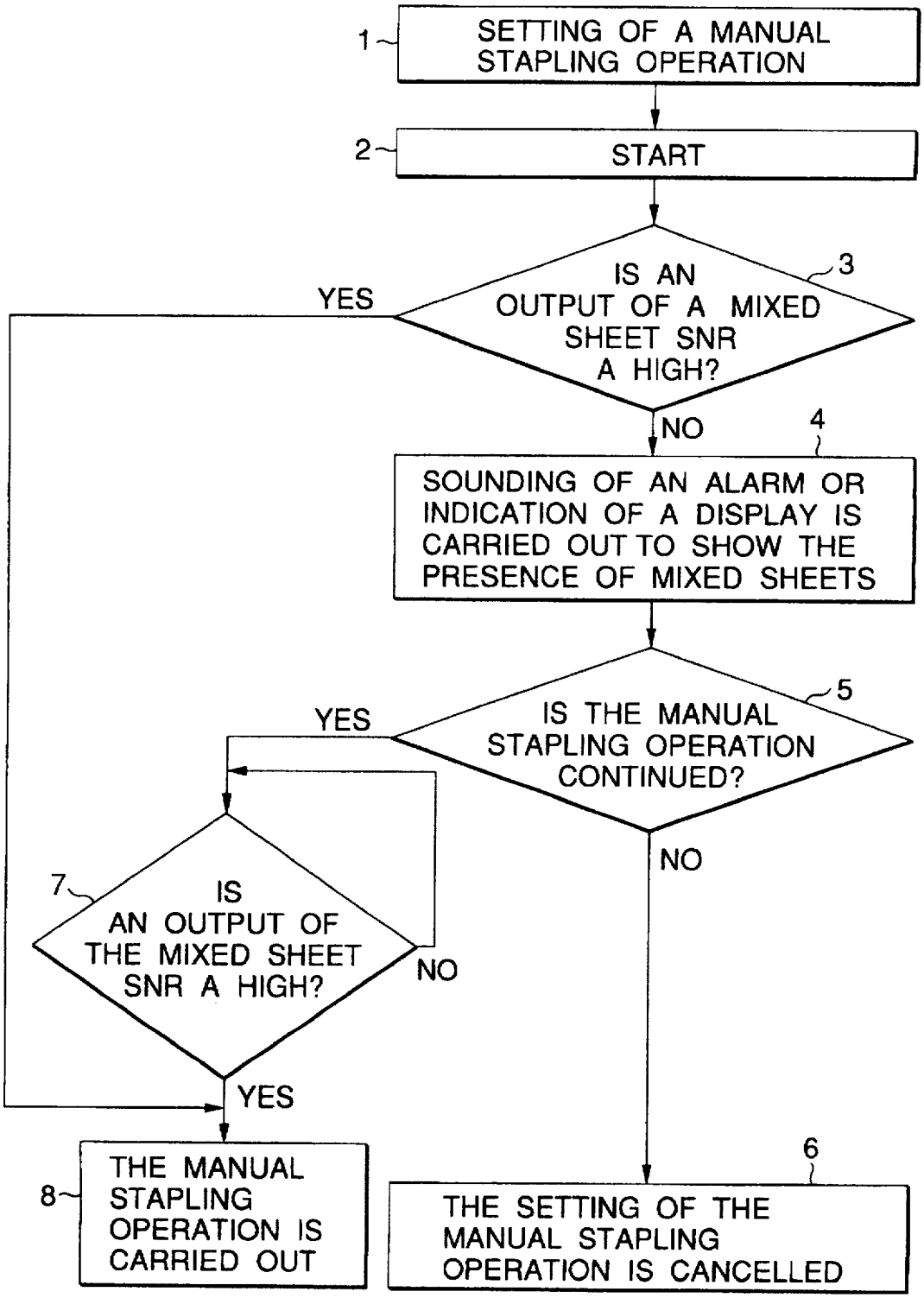
FIG. 35 is a flowchart showing manual stapling processes carried out by the sheet postprocessing apparatus according to the sixth embodiment.

FIG. 35 shows postprocessing operations related to the manual stapling operation based on a detection output from the previously-described transmission sensor 240.

In the drawing, if a starting operation is carried out after the manual stapling operation has been set, the manual stapling operation will be executed in the present embodiment. When the stapler head 71 has moved to the position of the batch of sheets of the sort-bin tray, it is checked whether or not the output of the transmission sensor 240 (i.e., the paper mixture sensor) is H (a high).

Unless a mixture of differently-punched sheets are detected (i.e., the output of the transmission sensor 240 is L (a low)), the manual stapling mode will be automatically continuously carried out. In contrast, if there are a mixture of differently-punched sheets (i.e., the output of the transmission sensor 204 is H), an interruption operation will be carried out. More specifically, the stapler head 71 will return to the withdrawal position (i.e., UNSTAPLE POSITION) without carrying out the stapling operation (i.e., the closing of the stapler head 71, or the stapling operation of the stapler head). These operations are carried out the number of times corresponding to the number of sort-bin trays used in the operation.

If a mixture of sheets are detected in the present embodiment, the sounding of an alarm or indication of a message, such as the lighting up of the mixture display lamp 232 (see FIG. 32), as well as the interruption operation will be carried out.

An operation as to whether or not the manual stapling mode is continued is performed. If the manual stapling mode is not continued, the settings of the manual stapling mode will be canceled. In contrast, if the manual stapling mode is continued, the manual stapling mode will be executed again. The manual stapling mode is continuously executed on condition that the output of the transmission sensor 240 is H (i.e., on condition that there is no mixture of differently-stapled sheets).

Therefore, for example, even if the manual stapling operation is continuously executed in the present embodiment, it will be impossible to carry out the manual stapling mode unless the output of the transmission sensor 240 becomes H.

Unless unwanted sheets are completely removed from the tray, it will be impossible to carry out the manual stapling mode. Consequently, prevention of execution of a stapling operation while differently-punched sheets are mixed together is ensured.

Further, in the present embodiment, it is possible to arrange the postprocessing apparatus so as to immediately carry out the manual stapling mode so long as the continuous operation is performed.

(Seventh Embodiment)

The present embodiment is arranged so as to check modifications on the postprocessing operation and to permit resetting of the details of the postprocessing operation in the priority processing method.

Figure 36:
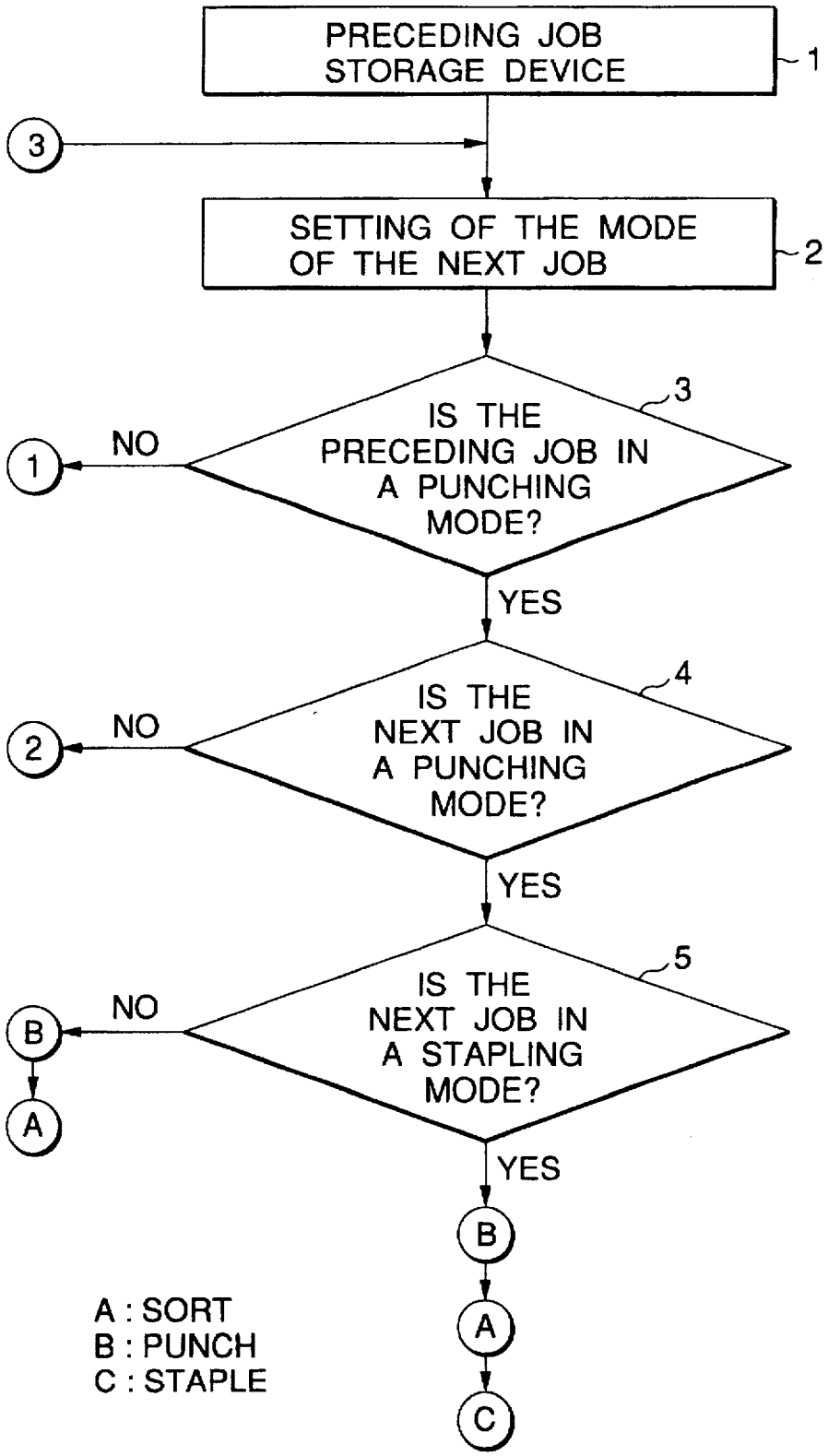
FIG. 36 is a first flowchart showing processing processes of a sheet postprocessing according to a seventh embodiment of the present invention.
Figure 37:
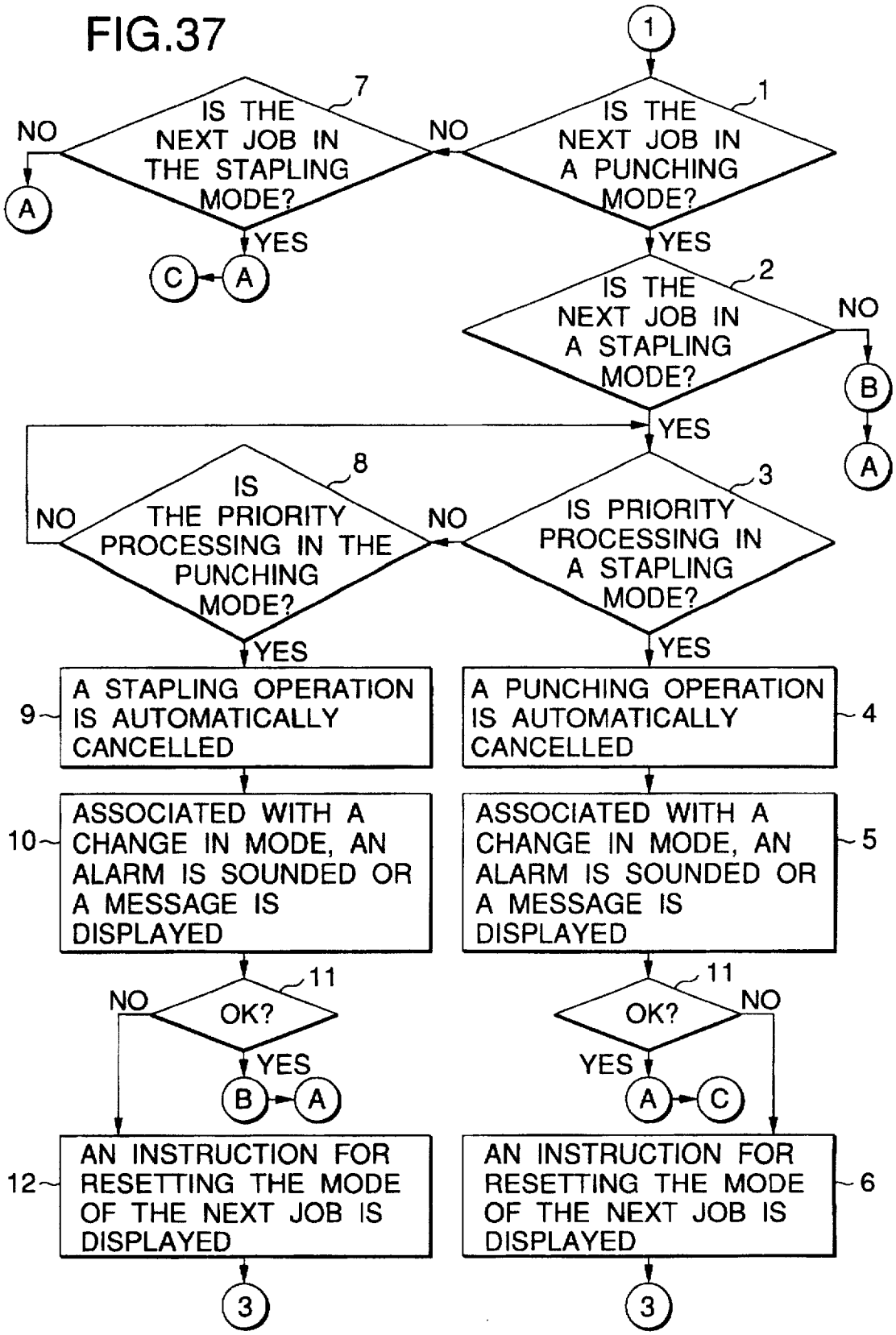
FIG. 37 is a second flowchart showing processing processes of the sheet postprocessing apparatus according to the seventh embodiment.
Figure 38:
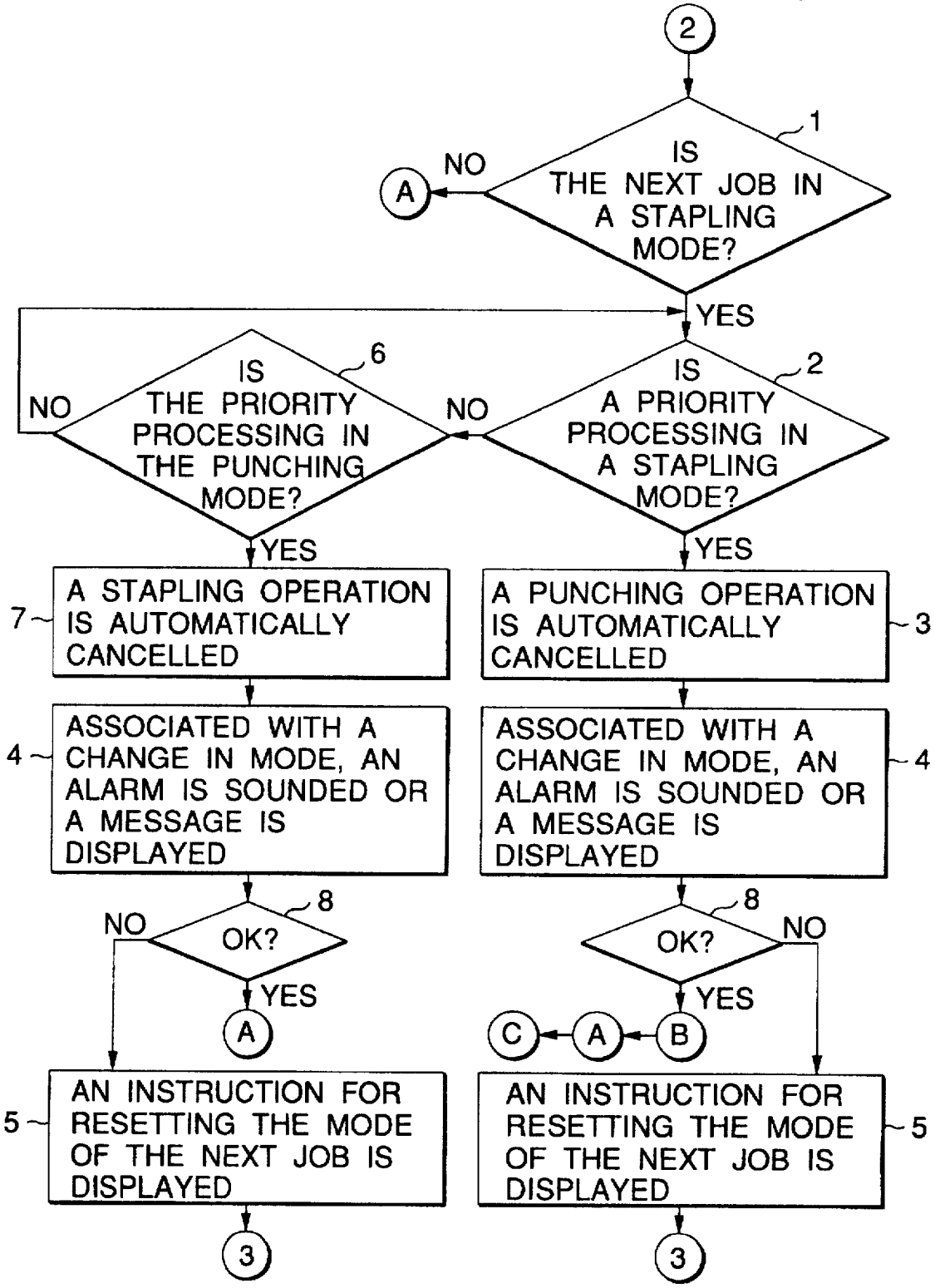
FIG. 38 is a third flowchart showing processing processes of the sheet postprocessing apparatus according to the seventh embodiment.

FIGS. 36 through 38 show flowcharts related to postprocessing of the present embodiment.

The present embodiment is, in principle, the same as the first embodiment substantially. After the automatic cancellation of the punching operation and the stapling operation as a result of the priority processing, or after automatic setting of the punching operation, the sounding of an alarm or indication of a message associated with a change in mode is carried out. In contrast with the first embodiment, an input operation is carried out with regard to whether or not details on the notification are acceptable, after the sounding of an alarm or indication of a message associated with a change in mode has been carried out. If an input operation indicating that the details are acceptable is carried out, the sequence of operations will be carried out according to the priority processing as in the case of the first embodiment. In contrast, if the input operation indicating that the details are acceptable is not carried out, a mode resetting instruction display for the next job (e.g., "Please reset a mode.") will be displayed. New postprocessing operations associated with the resetting of a mode for the next job are carried out.

Consequently, by virtue of the present embodiment, it becomes possible for the user to previously check whether or not details on priority processing are acceptable, when the priority processing is carried out according to the priority processing method.

(Eighth Embodiment)

Figure 39:
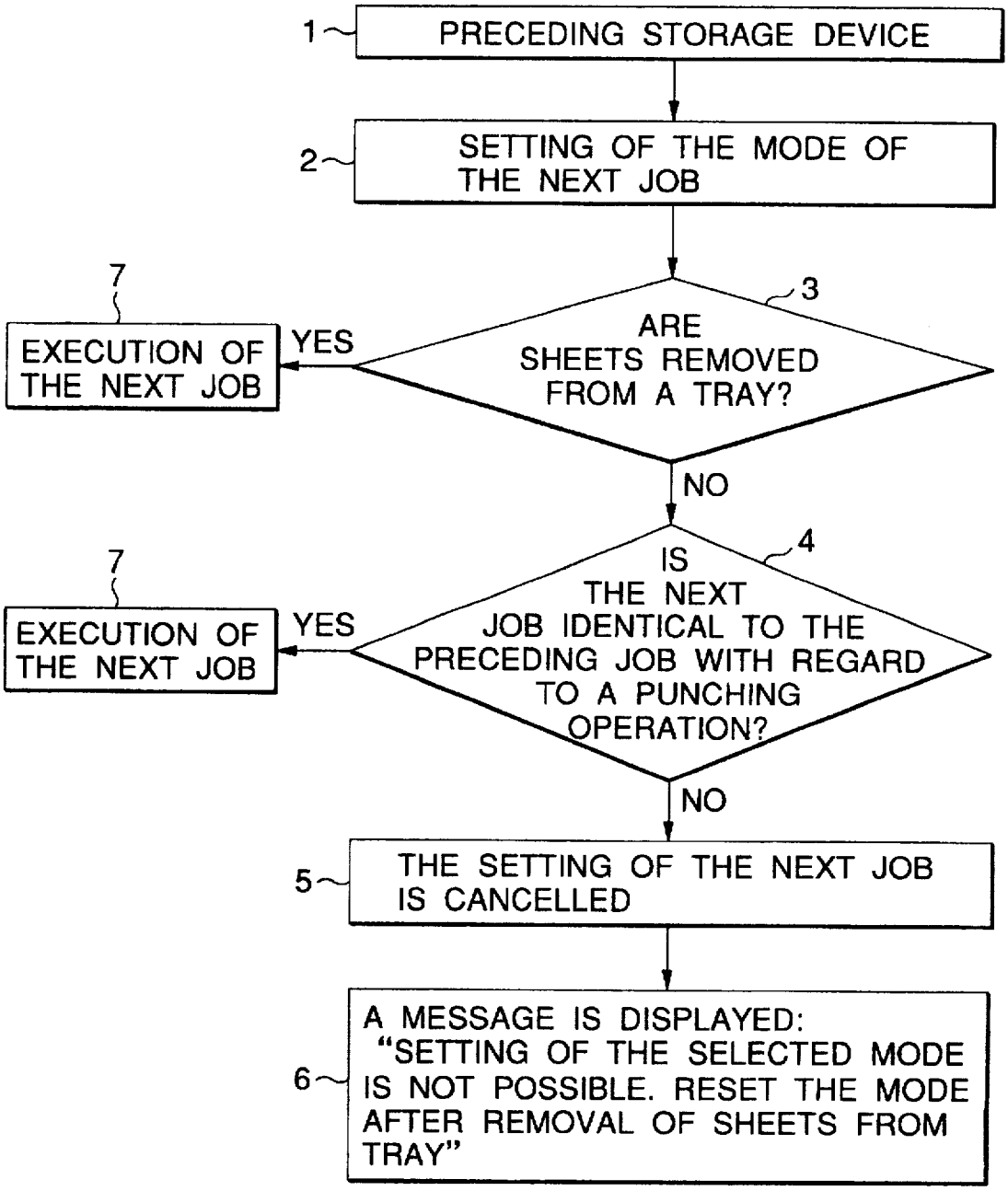
FIG. 39 is a flowchart showing processing processes of a sheet postprocessing apparatus according to an eighth embodiment.

The present embodiment is different from the previously-described embodiments. In short, the present embodiment is intended to prevent a mixture of differently-punched sheets. FIG. 39 shows a flowchart related to postprocessing operations of the present embodiment.

In the drawing, when the next job mode is set, it is first checked whether or not the sheets are removed from the sort-bin tray. If the sheets have been removed from the tray, the next job will be executed. In contrast, if the sheets still remain in the tray, it will be judged, on the basis of the information stored in the preceding job storage device, whether or not the next job is identical with the preceding job with regard to the punching operation. If these jobs are identical with each other with regard to the punching operation, the next job will be executed. If this is not the case, the settings of the next job will be canceled. Then, a message "This mode cannot be set. Please reset the mode after removal of the sheets from the tray." appears.

As has been described above, by virtue of the present invention, processing which is not desirable as the postprocessing comprised of a stapling operation and a punching operation is changed to desirable processing by means of the postprocessing modification means. Therefore, it is possible to prevent, at least, execution of a stapling operation while differently-punched sheets are mixed together. Consequently, it is possible to minimize errors in postprocessing a sheet.

By virtue of the present invention, it is possible to previously and simultaneously set both the stapling and punching operations to be carried out if postprocessing preset means is used as the postprocessing setting means.

Consequently, undesirable processing can be automatically changed to desirable processing with regard to both the stapling and punching operations.

If punching preset means and stapling post-setting means are used as the postprocessing setting means, the postprocessing modification means will permit continuous execution of the punching operation set by the punching preset means. It is only necessary for the postprocessing modification means to decide only whether or not the stapling operation set by the stapling post-setting means is possible, at the time of setting of the last job. As a result, it is possible to arbitrarily set the stapling operation (e.g., a manual stapling operation) independent of the punching operation.

Further, by virtue of the present invention, if a priority processing method by which either the stapling or punching operation is prioritized is employed in changing the processing that is undesirable as the postprocessing is changed to desirable processing, it will be possible to easily change the undesirable processing related to both the stapling and punching operations to desirable processing.

In the priority processing method, if either the stapling operation or the punching operation is prioritized by default, it will be possible to immediately carry out priority processing without waiting for user's specification of the operation. In contrast, it is possible to execute priority processing under the requirements meeting user's demands so long as an object to be prioritized is variably and arbitrarily set.

If details on the processing of priority processing control means are set in an optimum manner on the basis of specific assumption related to the object to be prioritized, the details of the settings of the preceding job, and the details of the settings of the next job, as described in, e.g., claims 6 to 9, it will be possible to easily ensure implementation of the priority processing method.

Further, by virtue of the present invention, if a postprocessing prohibition method which prohibits postprocessing of the next job is employed in changing the processing that is undesirable as the postprocessing is changed to desirable processing, it will be possible to ensure prevention of undesirable processing and complete prevention of errors in postprocessing sheets.

Further, in the present invention, advance notification means is provided so as to give advance notification as to the fact that details on preset postprocessing operations of the next job are undesirable. The postprocessing modification means is arranged so as to carry out operations in conjunction with an instruction following the notification issued by the advance notification means. As a result, it is possible for the user to constantly ascertain modifications made on the details of the postprocessing, which in turn makes it possible to ensure prevention of execution of the postprocessing operations which are not intended by the user.

In the present invention, if post-notification means is provided so as to give notice as to the fact that the postprocessing modification means has modified the postprocessing operation, it will be possible for the user to constantly ascertain how the postprocessing operation was changed. Therefore, the user can easily determine whether or not the modified postprocessing operation is desirable.

If a method by which the prohibited next job is executed again under predetermined conditions after the post-notification means has issued notice, is appended to the postprocessing prohibition method, it will become possible for the user to select prohibition of the postprocessing or execution of the same, as required. Therefore, it is possible to easily realize the postprocessing operation meeting user's demands.

Further, in the present invention, if single-job sheet postprocessing execution means is provided, and if sheets of a single job are unconditionally subjected to a stapling operation on condition that the postprocessing setting means sets the next job to the stapling operation, execution of postprocessing for the sheets of the single job can be ensured. As a result, the postprocessing performance of the sheet can be improved to a much greater extent.

Particularly, if mixed sheet determination means and forcible stapling means are provided as the single-job sheet postprocessing means, postprocessing for the sheets of the single job can be reliably realized.

In the present invention, details on the punching operation will be increased if a unit for executing punching operations which are different from each other at least with regard to the number or position of holes, is used as the punching unit. As a result, the postprocessing performance of the sheet can be increased to a much greater extent.

Further, in the present invention, a method by which punching information set with respect to the preceding job is stored in storage means and the thus-stored information is retrieved and determined, is adopted as punching information determination means, punching information can be automatically determined on the basis of the details of the postprocessing operation set by the postprocessing setting means. The determination operation for the punching information can be easily effected accordingly.

In contrast, if a method by which a punched state of the batch of sheets stored in a tray as a result of the preceding job is detected by means of punched state detection means, is employed, it will be possible to reliably ascertain the punched state of the batch of remaining sheets even if some of the sheets are removed from the tray.

What is claimed is:

1. A sheet postprocessing apparatus that continuously receives sheets which relate to a plurality of jobs and have images formed thereon by an image forming main unit, said sheet postprocessing apparatus comprising:

sheet holding means that stores the sheets having images formed thereon by said image forming main unit, into trays;

a stapling unit for stapling one side edge of a batch of sheets stored in said tray of said sheet holding means in a predetermined manner;

a punching unit which is disposed in the course of travel of the sheet having an image formed thereon by said image forming main unit, before arrival at said sheet holding means, and which punches holes in one side edge of the sheet in a predetermined manner while it is in the course of travel;

postprocessing setting means that sets details on postprocessing related to the stapling and punching of the sheet having an image formed thereon;

stapling control means which staples the batch of sheets stored in said tray in a predetermined manner according to the details of the stapling operation set by said postprocessing setting means;

punching control means that punches holes in the sheet in a predetermined manner while it is in the course of travel, according to the details of the punching operation set by said postprocessing setting means;

punching information determination means that determines punching information on the sheets stored in said tray as a result of the preceding job; and postprocessing modification means that changes details on the postprocessing of the next job so as to prohibit, at least, a stapling operation while the differently-punched sheets are mixed together on condition that the punching information received from said punching information determination means is different from the details of the postprocessing of the next job set by said postprocessing setting means.

2. The sheet postprocessing apparatus of claim 1, wherein said postprocessing setting means is postprocessing preset means which previously sets details on postprocessing related to the stapling and punching of the sheet, on which an image is to be formed, before commencement of an image forming operation.

3. The sheet postprocessing apparatus of claim 2, wherein said postprocessing modification means comprises:

priority processing determination means for determining which of a stapling operation or a punching operation will be accepted first, and priority processing control means which executes the processing determined by the priority processing determination means in a prioritized manner so as to accord with the punching information on condition that the punching information received from said punching information determination means is different from details on the postprocessing set by said postprocessing determination means.

4. The sheet postprocessing apparatus of claim 3, wherein said priority processing determination means processes either the stapling operation or the punching operation by default in a prioritized manner.

5. The sheet postprocessing apparatus of claim 3, wherein said priority processing determination means arbitrarily sets the object to be subjected to the priority processing.

6. The sheet postprocessing apparatus of claim 3, wherein if said postprocessing setting means sets only the stapling operation during the next job on condition that priority processing is set to the stapling operation, and that the sheets stored in said tray are currently being subjected to a predetermined punching operation, said priority processing control means will automatically execute the same punching operation as it has already been done during the preceding job as well as the stapling operation.

7. The sheet postprocessing apparatus of claim 3, wherein if said postprocessing setting means sets the stapling and punching operations during the next job on condition that the priority processing is set to the stapling operation, and that the sheets stored in said tray have not been punched during the preceding job, said priority processing control means will carry out solely the stapling operation by automatically canceling the punching operation.

8. The sheet postprocessing apparatus of claim 3, wherein if said postprocessing setting means sets only the stapling operation during the next job on condition that priority processing is set to the punching operation, and that the sheets stored in said tray are currently being subjected to a predetermined punching operation, said priority processing control means will automatically cancel the stapling operation.

9. The sheet postprocessing apparatus of claim 3, wherein if said postprocessing setting means sets the stapling and punching operations during the next job on condition that the priority processing is set to the punching operation, and that the sheets stored in said tray have not been punched during the preceding job, said priority processing control means will solely carry out the punching operation by automatically canceling the stapling operation.

10. The sheet postprocessing apparatus of claim 2, wherein said postprocessing modification means is postprocessing prohibition means which prohibits postprocessing of the next job on condition that the punching information received from said punching information determination means is different from details on the postprocessing of the next job set by said postprocessing setting means.

11. The sheet postprocessing apparatus of claim 1, wherein said postprocessing setting means comprises:

punching preset means that previously sets details on the punching of the sheet on which an image is to be formed, before commencement of an image forming operation, and stapling post-setting means that sets details on the stapling of the sheet on which an image is to be formed, after completion of the image formation;

said punching control means punches holes in the sheet in a predetermined manner while it is in the course of travel, according to the details of the punching operation set by said punching preset means;

said stapling control means which staples the batch of sheets stored in said tray in a predetermined manner according to the details of the stapling operation set by said stapling post-setting means; and said postprocessing modification means comprising:

said postprocessing prohibition means which prohibits, at least, the stapling operation on condition that the stapling operation is set by said stapling post-setting means, and that said punching information determination means determines that a mixture of differently-punched sheets are stored in said tray.

12. The sheet postprocessing apparatus of claim 1, wherein said postprocessing modification means, further comprises:

advance notification means which issues advance notice of the difference between the punching information received from said punching information determination means and details on the postprocessing of the next job set by said postprocessing setting means, and said postprocessing modification means executes processing in conjunction with an instruction following the notice issued by said advance notification means.

13. The sheet postprocessing apparatus of claim 1, wherein said postprocessing modification means, further comprises:

post-notification means issues notice of execution of processing differing from details on the postprocessing set by said postprocessing setting means, on condition that the processing has been carried out.

14. The sheet postprocessing apparatus of claim 13, wherein said postprocessing setting means is said postprocessing preset means which previously sets details on postprocessing related to the stapling and punching of the sheet, on which an image is to be formed, before commencement of an image forming operation; and said postprocessing modification means comprises:

postprocessing prohibition means which prohibits the postprocessing of the next job on condition that the punching information received from said punching information determination means is different from details on the postprocessing of the next job set by said postprocessing setting means, and postprocessing reexecution means which reexecutes the postprocessing of the next job on condition that the punching information accords with the details of the postprocessing of the next job reset by said postprocessing setting means after said post-notification means has issued a notice.

15. The sheet postprocessing apparatus of claim 13, wherein said postprocessing setting means comprises:

punching preset means that previously sets details on the punching of the sheet on which an image is to be formed, before commencement of an image forming operation, and stapling post-setting means that sets details on the stapling of the sheet on which an image is to be formed, after completion of the image formation; and said postprocessing modification means comprises:

said postprocessing prohibition means which prohibits the stapling operation on condition that the stapling operation is set by said stapling post-setting means, and that said punching information determination means determines that a mixture of differently-punched sheets are stored in said tray, and said postprocessing reexecution means which reexecutes the postprocessing of the next job that has already been set or reset by said stapling postprocessing means in conjunction with an instruction for reexecution of the postprocessing after said post-notification means has issued a notice.

16. The sheet postprocessing apparatus of claim 1, wherein said postprocessing modification means further comprises:

single-job sheet postprocessing execution means which unconditionally executes a stapling operation with respect to said tray that solely contains the sheets of a single job, on condition that said postprocessing setting means sets the stapling operation.

17. The sheet postprocessing apparatus of claim 16, wherein said single-job sheet postprocessing execution means comprises:

mixed sheet determination means which determines whether or not a mixture of sheets of a plurality of jobs are contained in said tray to be processed, and forcible stapling means which unconditionally staples the sheets stored in said tray on condition that said postprocessing setting means sets the stapling operation, and that the sheets loaded in said tray which is to be determined by said mixed sheet determination means are determined as belonging to a single job.

18. The sheet postprocessing apparatus of claim 1, wherein said punching unit executes at least one of punching operations which are different from each other with regard to the number of holes and the position of the hole.

19. The sheet postprocessing apparatus of claim 1, wherein said punching information determination means stores the punching information of the preceding job set by said postprocessing setting means in memory means and determines the punching information when executing the postprocessing of the next job by retrieving the memory means.

20. The sheet postprocessing apparatus of claim 1, wherein said punching information determination means comprises:

punched state detection means which detects a punched state of the batch of sheets stored in said tray as a result of the preceding job, and said punching information determination means determines the punching information on the basis of a detection signal received from said punched state detection means.

* * * * *